US012359676B2

(12) United States Patent
Chen

(10) Patent No.: US 12,359,676 B2
(45) Date of Patent: Jul. 15, 2025

(54) COMBINED FAN

(71) Applicant: Xiaobin Chen, Shenzhen (CN)

(72) Inventor: Xiaobin Chen, Shenzhen (CN)

(73) Assignee: Shenzhen Daxing Technology Co., Ltd., Shenzhen (CN)

( * ) Notice: Subject to any disclaimer, the term of this patent is extended or adjusted under 35 U.S.C. 154(b) by 0 days.

(21) Appl. No.: 18/947,001

(22) Filed: Nov. 14, 2024

(65) Prior Publication Data

US 2025/0067278 A1 Feb. 27, 2025

(51) Int. Cl.
*F04D 25/16* (2006.01)
*F04D 29/52* (2006.01)

(52) U.S. Cl.
CPC ..... *F04D 29/522* (2013.01); *F04D 25/166* (2013.01)

(58) Field of Classification Search
CPC ..... F04D 29/522; F04D 25/166
See application file for complete search history.

(56) References Cited

U.S. PATENT DOCUMENTS 12,038,019 B2 * 7/2024 Spaulding ..... F04D 25/166
2024/0426306 A1 * 12/2024 Tsai ..... F04D 29/005

FOREIGN PATENT DOCUMENTS

CN 307268210 S † 4/2022
CN 221683231 B1 † 9/2024

* cited by examiner
† cited by third party

*Primary Examiner* — Sabbir Hasan

(57) ABSTRACT

A combined fan includes a first fan, a second fan, a connector and a first clamping member. The first fan provided with a first connecting portion. The second fan provided with a second connecting portion. The connector connected to the first connecting portion and the second connecting portion to connect the first fan with the second fan in parallel. The first clamping member is arranged on at least one of the first fan, the second fan, and the connector, and the first clamping member is configured to be connected to a clamping position. During use, the connector is connected to the first connecting portion and the second connecting portion, thereby connecting the first fan to the second fan to form a whole.

19 Claims, 20 Drawing Sheets

COMBINED FAN

TECHNICAL FIELD

The present disclosure relates to the technical field of portable fans, and in particular, to a combined fan.

BACKGROUND OF THE INVENTION

Fans, as electrical appliances that generate an air flow, accelerate air circulation, and dissipate heat, are fully used in daily life, especially in the burning hot summer. There are also many types of fans, including ceiling fans, floor fans, and mobile portable fans. The portable fans are particularly popular due to their advantages of being easy to carry, convenient to use, and suitable for various places.

At present, through handles, it is convenient for users to hold some existing portable fans on the market for use. Some existing portable fans are connected to the bodies or clothes of the users through a sling. Some existing portable fans are placed on a plane such as a tabletop through small-sized stands. However, this type of product is usually small in size and only has one air blowing assembly, which generates low air flow intensity and makes it difficult to achieve rapid cooling. As a result, a user experience is poor.

Therefore, the present disclosure provides a combined fan that can effectively solve the above problems. The combined fan has a simple structure. The generated air flow intensity is high, so that the cooling effect is obvious. Furthermore, it is convenient for a user to carry the combined fan.

SUMMARY OF THE INVENTION

In order to overcome the shortcomings of the prior art, the present disclosure provides a combined fan. The combined fan has a simple structure. The generated air flow intensity is high, so that the cooling effect is obvious. Furthermore, it is convenient for a user to carry the combined fan.

A combined fan, includes:

a first fan, provided with a first connecting portion;

a second fan, provided with a second connecting portion;

a connector, connected to the first connecting portion and the second connecting portion to connect the first fan with the second fan in parallel; and a first clamping member, wherein the first clamping member is arranged on at least one of the first fan, the second fan, and the connector, and the first clamping member is configured to be connected to a clamping position.

As an improvement of the present disclosure, the combined fan further includes a supporting member, the supporting member is rotatably connected to the first clamping member through a connecting shaft and is rotated between a closed position and an opened position; the first clamping member is provided with a groove; when the supporting member is rotated to the closed position, at least a part of the supporting member is inserted into the groove; and when the supporting member is rotated to the opened position, an outer surface of the supporting member resists against an inner wall of the groove.

As an improvement of the present disclosure, a clamping block is arranged on one of an edge of the supporting member and the inner wall of the groove; a clamping slot is provided in the other one of the edge of the supporting member and the inner wall of the groove; and when the supporting member is rotated to the closed position, the clamping block is clamped to the clamping slot.

As an improvement of the present disclosure, the first clamping member is further provided with a finger groove; and the finger groove is communicated to the groove and is configured to allow a finger of a user to be inserted for use.

As an improvement of the present disclosure, the combined fan further includes a second clamping member, a connecting end of the first clamping member is connected to an upper part of a front surface of the first fan and/or an upper part of a front surface of the second fan; a clamping end of the first clamping member extends towards a lower part of the front surface of the first fan and/or a lower part of the front surface of the second fan; a connecting end of the second clamping member is connected to a lower part of a rear surface of the first fan and/or a lower part of a rear surface of the second fan; and a clamping end of the second clamping member extends towards an upper part of the rear surface of the first fan and/or an upper part of the rear surface of the second fan.

As an improvement of the present disclosure, the connector is a hook; the hook includes a connecting portion, an extending portion, and a hook portion; the first connecting portion and/or the second connecting portion are connecting holes; the second connecting portion and/or the first connecting portion are L-shaped hook slots; the connecting portion is connected to the connecting holes; the hook portion and at least a part of the extending portion are inserted into the hook slot; and the hook portion is clamped to the hook slot.

As an improvement of the present disclosure, a first positioning portion is arranged on a surface of the first fan; a second positioning portion is arranged on a surface of the second fan; and when the first fan and the second fan are connected by the hook, the first positioning portion is clamped to the second positioning portion.

As an improvement of the present disclosure, "C"-shaped slots are provided in two end portions of the connector; the first connecting portion and the second connecting portion are both provided with cylindrical portions; and the cylindrical portions are clamped in the slots and rotated inside the slots.

As an improvement of the present disclosure, stop blocks are arranged on inner walls of the slots; the cylindrical portions are provided with stop slots spaced apart from each other in a circumferential direction; and when the cylindrical portions are rotated relative to the slots, the stop blocks slide from one stop slot to the other adjacent stop slot.

As an improvement of the present disclosure, two gaps are provided in two end portions of the connector in a manner of spacing away from each other in axial directions of the cylindrical portions; the two gaps penetrate through side walls of the slots and are communicated to the slots; the side walls of the slots between the two gaps are deformation portions; the stop blocks are arranged at the deformation portions; and extending directions of the stop blocks and extending directions of the stop slots are parallel to the axial directions of the cylindrical portions.

As an improvement of the present disclosure, the first fan is provided with a first accommodating slot; the second fan is provided with a second accommodating slot; the two cylindrical portions are respectively arranged in the first accommodating slot and the second accommodating slot; and two end portions of the connector are respectively inserted into the first accommodating slot and the second accommodating slot, so that the two cylindrical portions are respectively clamped in the two slots.

As an improvement of the present disclosure, shaft holes are provided in two end portions of the connector; both the first connecting portion and the second connecting portion are rotating shafts; and the rotating shafts are inserted into the shaft holes and rotate inside the shaft holes.

As an improvement of the present disclosure, clamping blocks are arranged at free ends of the rotating shafts; when the rotating shafts are inserted into the shaft holes, the clamping blocks are connected to positions, close to edges of the shaft holes, on the connector; central through holes and deformation slots communicated to the central through holes are provided in the free ends of the rotating shafts; and when the free ends of the rotating shafts are inserted along the shaft holes, the deformation slots allow the free ends of the rotating shafts to deform.

As an improvement of the present disclosure, sliding chutes are arranged at two end portions of the connector; the first connecting portion and the second connecting portion are both sliding blocks; and the sliding blocks are slidably inserted into the sliding chutes.

As an improvement of the present disclosure, positioning portions are arranged on surfaces of the sliding blocks in a protruding manner; positioning slots are provided in inner walls of the sliding chutes; the positioning portions are clamped with the positioning slots; guide portions with narrow front parts and wide rear parts are arranged at end portions of the sliding blocks; and the guide portions are inserted along the end portions of the sliding chutes to guide the sliding blocks to enter the sliding chutes.

As an improvement of the present disclosure, a first insertion slot and a first insertion block are arranged at each of two end portions of the connector, and each of the first connecting portion and the second connecting portion includes a second insertion slot and a second insertion block; the first insertion blocks are inserted into the second insertion slots, and the second insertion blocks are inserted into the first insertion slots; and an orientation of a free end of each first insertion block is opposite to an orientation of a free end of each second insertion block.

As an improvement of the present disclosure, limiting sheets are arranged at two end portions of the connector; a limiting slot is formed between each limiting sheet and an end wall of the connector; the limiting sheets are provided with strip-type holes communicated to the limiting slots; the first connecting portion and the second connecting portion both include limiting blocks; a diameter of a free end of each limiting block is greater than a diameter of a middle part of the limiting block; the middle parts of the limiting blocks are inserted into the strip-type holes; and the free ends of the limiting blocks are inserted into the limiting slots and resist against inner walls of the limiting slots.

As an improvement of the present disclosure, the limiting sheets are provided with insertion ports communicated to the strip-type holes; the insertion ports are arranged at end portions of the strip-type holes; a diameter of each insertion port is greater than the diameter of the free end of each limiting block; and the free ends of the limiting blocks are inserted into the limiting slots along the insertion ports.

As an improvement of the present disclosure, each of the first connecting portion and the second connecting portion includes two limiting convex strips spaced apart from each other; a distance between the two limiting convex strips matches a width of each limiting sheet; and the limiting sheets are inserted along gaps between the two limiting convex strips to cause the free ends of the limiting blocks to be inserted into the limiting slots along the insertion ports.

As an improvement of the present disclosure, the first fan and/or the second fan is provided with a rope hole; and the rope hole is configured to allow a rope to pass through.

The present disclosure has the beneficial effects: By the arrangement of the above structure, during use, the connector is connected to the first connecting portion and the second connecting portion, thereby connecting the first fan to the second fan to form a whole. By clamping and connecting the first clamping member to clothing such as a belt and a waistband, the combined fan can be fixed, freeing up the hands of a user and making it convenient for use.

BRIEF DESCRIPTION OF DRAWINGS

In order to explain the technical solutions of the embodiments of the present disclosure more clearly, the following will briefly introduce the accompanying drawings used in the embodiments. The drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE INVENTION

Figure 1:
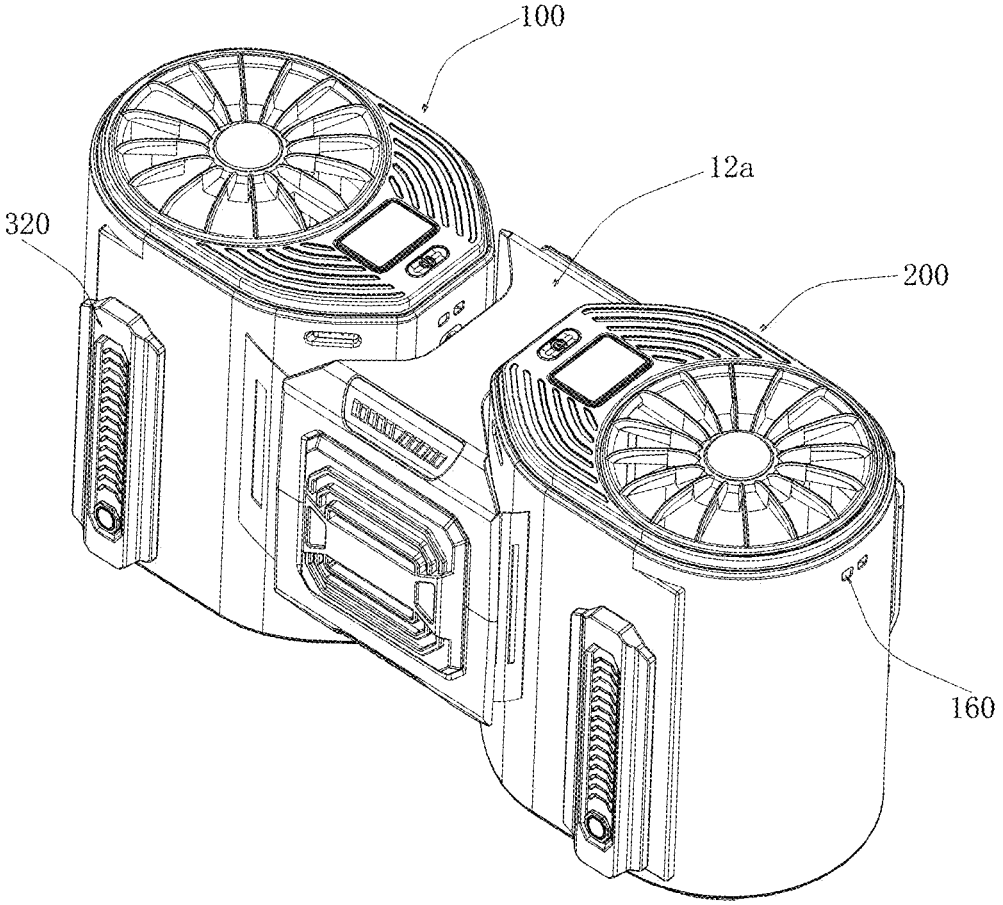
FIG. 1 is a schematic diagram of a first entire structure of Embodiment I of the present disclosure.

To make the aforementioned objectives, features, and advantages of the present disclosure more comprehensible, specific implementations of the present disclosure are described in detail below in conjunction with the accompanying drawings. In the following description, numerous specific details are set forth to provide a thorough understanding of the present disclosure. The present disclosure may, however, be embodied in many forms different from that described here. A person skilled in the art can make similar improvements without departing from the connotation of the present disclosure. Therefore, the present disclosure is not limited by the specific embodiments disclosed below.

In the description of the present disclosure, It is to be understood that, The terms "center", "longitudinal", "transverse", "upper", "lower", "front", "rear", "left", "right", "vertical", "horizontal", "top", "bottom", "inner", "outer", "clockwise", "counterclockwise", and the like indicate azimuth or positional relationships based on the azimuth or positional relationships shown in the drawings, For purposes of convenience only of describing the present disclosure and simplifying the description, Rather than indicating or implying that the indicated device or element must have a particular orientation, be constructed and operated in a particular orientation, therefore, not to be construed as limiting the present disclosure.

In addition, the terms "first" and "second" are used for descriptive purposes only, while not to be construed as indicating or implying relative importance or implicitly specifying the number of technical features indicated thereby, features defining "first," "second," and "second" may explicitly or implicitly include one or more of the described features. In the description of the present disclosure, "multiple" means two or more unless explicitly specified otherwise.

In addition, the terms "install", "arrange", "provide", "connect" and "couple" should be understood broadly. For example, it can be a fixed connection, a detachable connection, an integral structure, a mechanical connection, an electrical connection, a direct connection, an indirect connection through an intermediate medium, or a communication between two devices, elements or components. For ordinary technical personnel in this field, the specific meanings of the above terms in present disclosure can be understood based on specific circumstances.

In the present disclosure, unless specific regulation and limitation otherwise, the first feature "onto" or "under" the second feature may include the direct contact of the first feature and the second feature, or may include the contact of the first feature and the second feature through other features between them instead of direct contact. Moreover, the first feature "onto", "above" and "on" the second feature includes that the first feature is right above and obliquely above the second feature, or merely indicates that the horizontal height of the first feature is higher than the second feature. The first feature "under", "below" and "down" the second feature includes that the first feature is right above and obliquely above the second feature, or merely indicates that the horizontal height of the first feature is less than the second feature.

It should be noted that when an element is referred to as being "fixed to" another element, the element can be directly on another component or there can be a centered element. When an element is considered to be "connected" to another element, the element can be directly connected to another element or there may be a centered element. The terms "inner", "outer", "left", "right", and similar expressions used herein are for illustrative purposes only and do not necessarily represent the only implementation.

Figure 2:
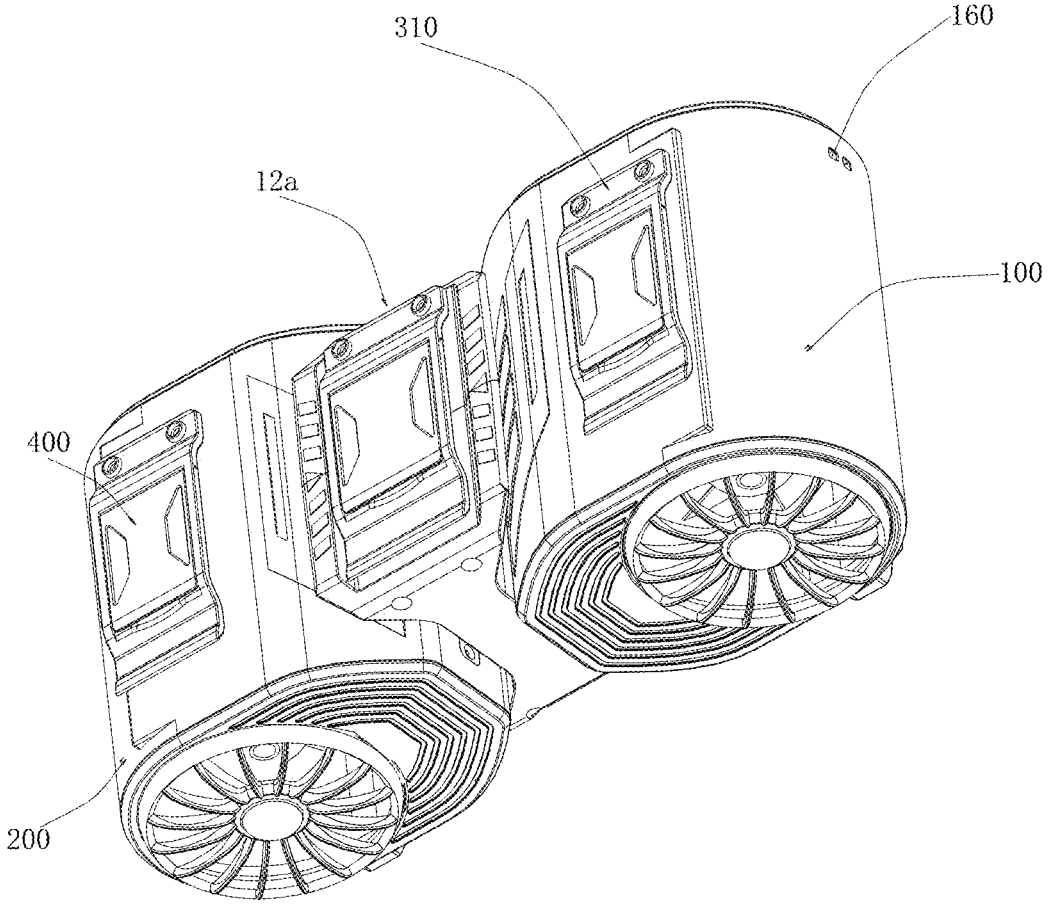
FIG. 2 is a schematic diagram of a second entire structure of Embodiment I of the present disclosure.
Figure 3:
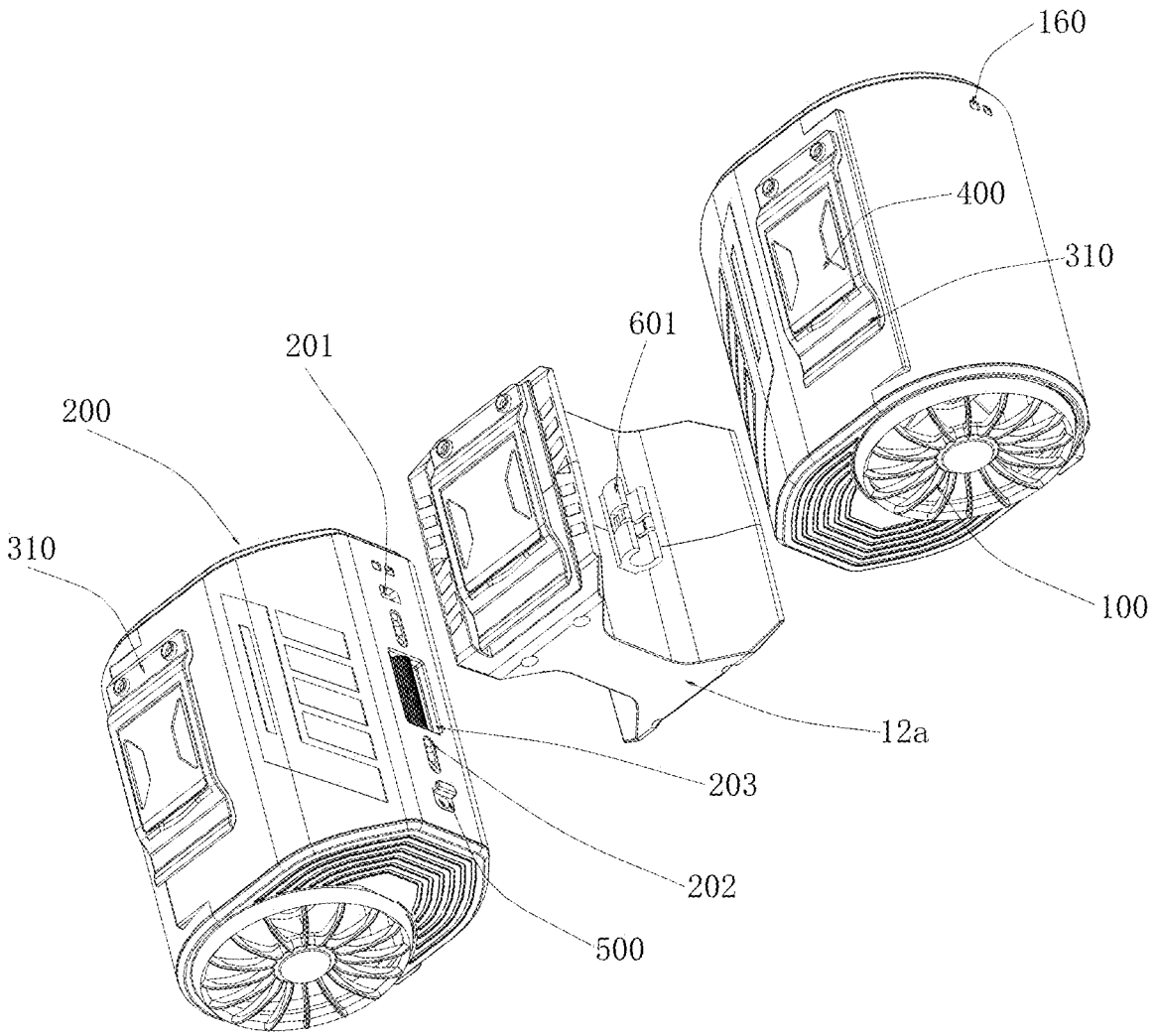
FIG. 3 is a first exploded structural diagram of Embodiment I of the present disclosure.
Figure 4:
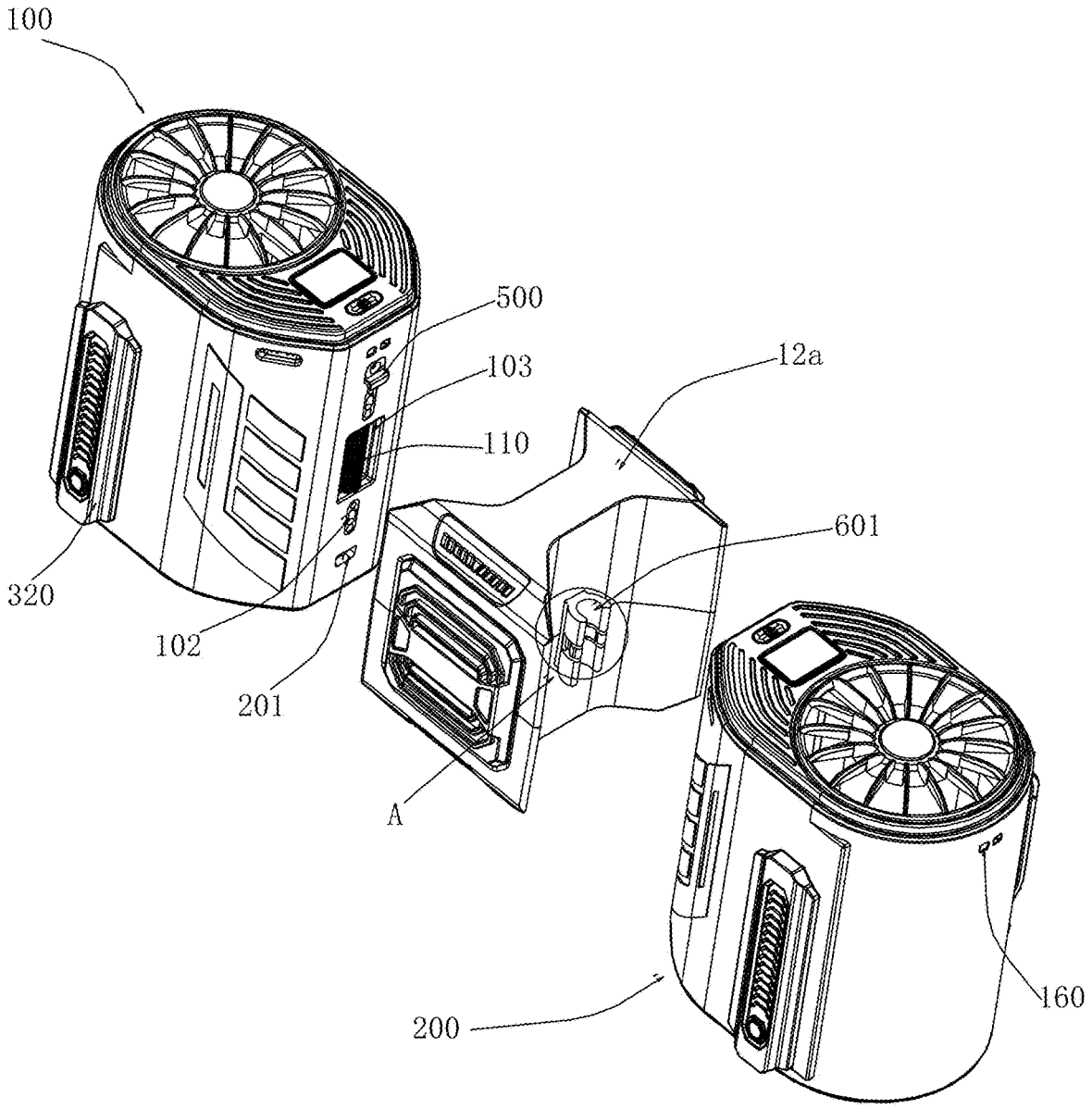
FIG. 4 is a second exploded structural diagram of Embodiment I of the present disclosure.
Figure 5:
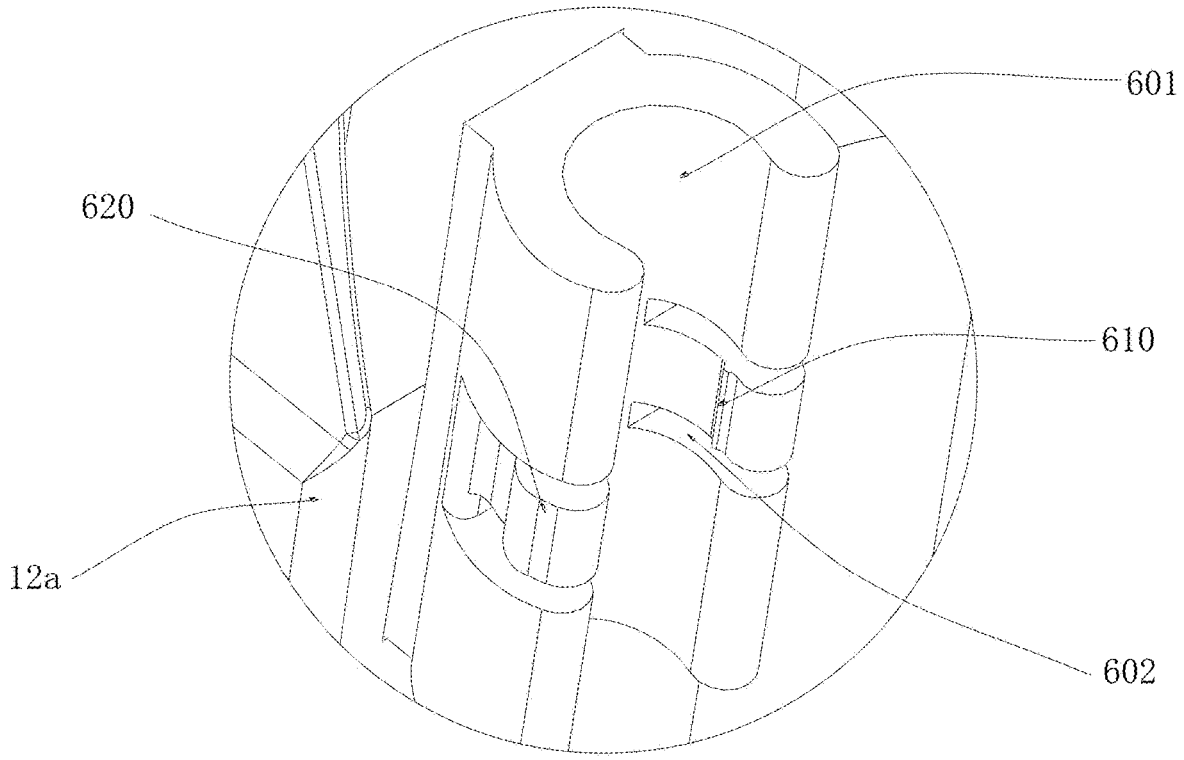
FIG. 5 is an enlarged view of circle A in FIG. 4.
Figure 6:
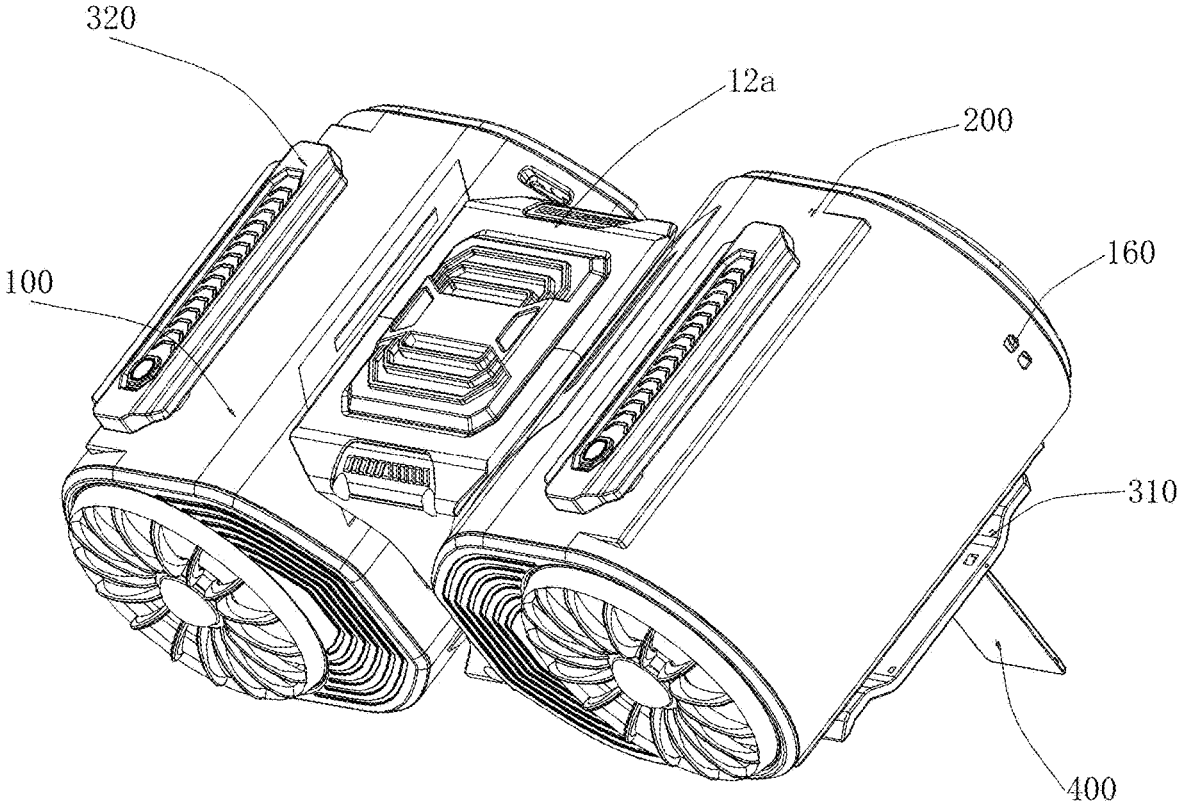
FIG. 6 is a schematic diagram of a first entire structure in an opened state of a supporting member of Embodiment I of the present disclosure.
Figure 7:
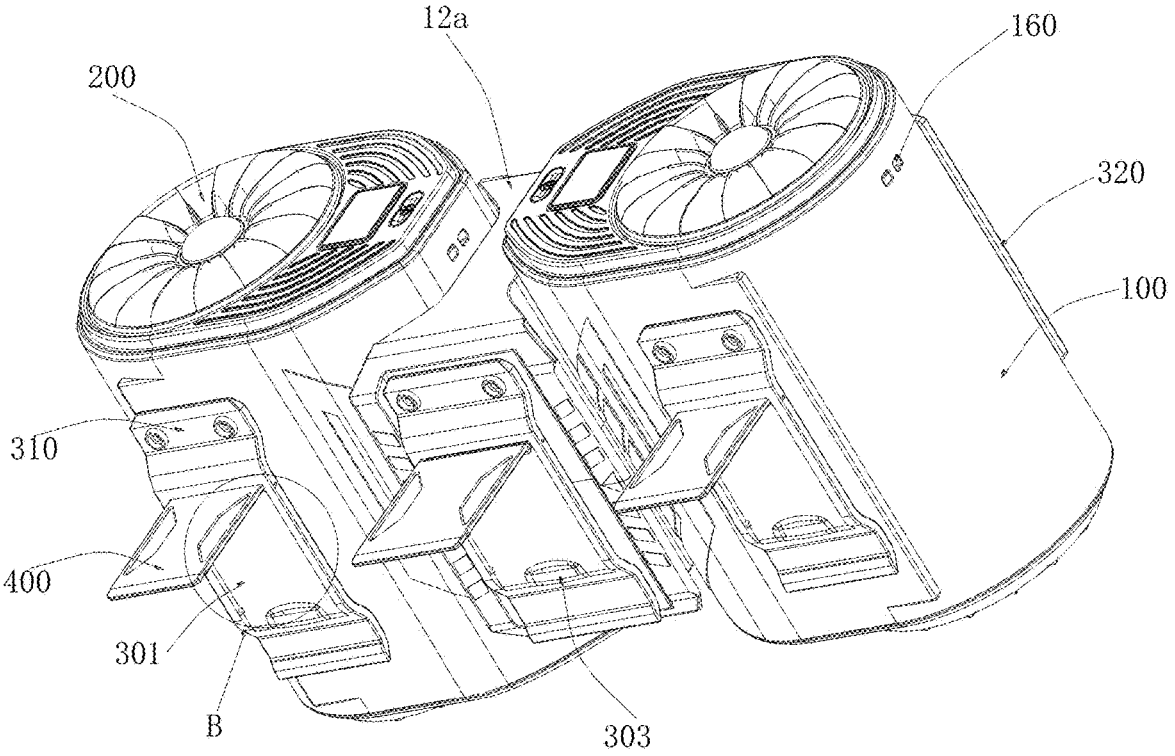
FIG. 7 is a schematic diagram of a second entire structure in an opened state of a supporting member of Embodiment I of the present disclosure.
Figure 8:
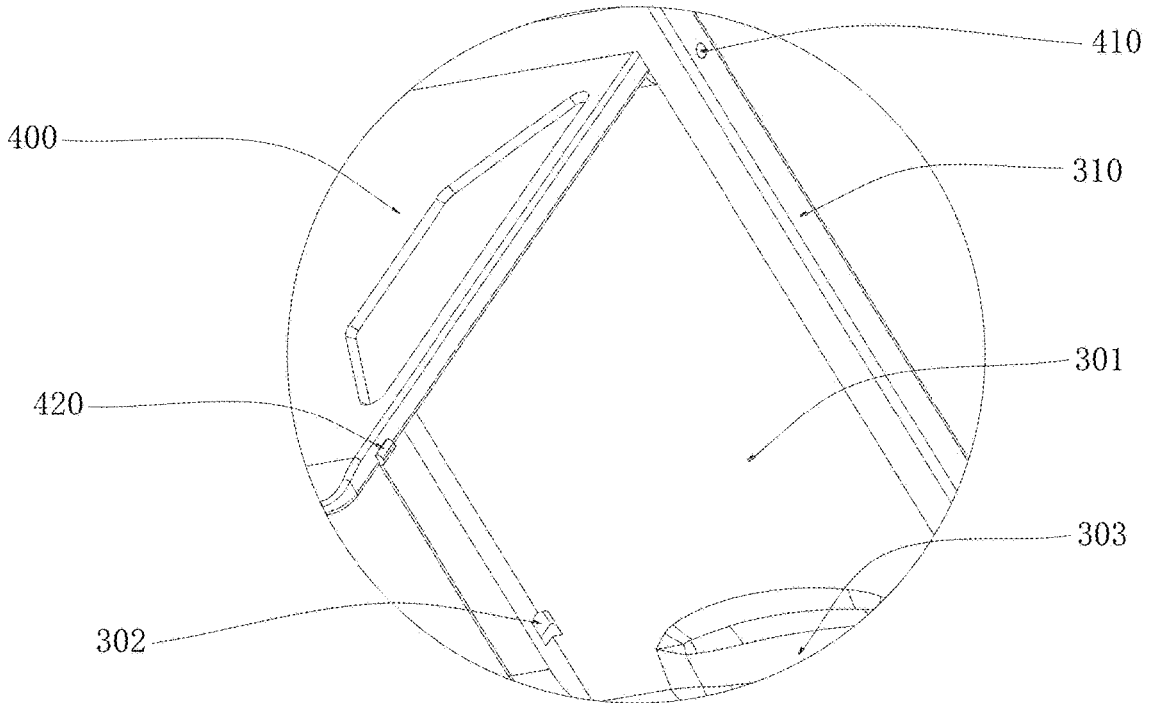
FIG. 8 is an enlarged view of circle B in FIG. 7.
Figure 9:
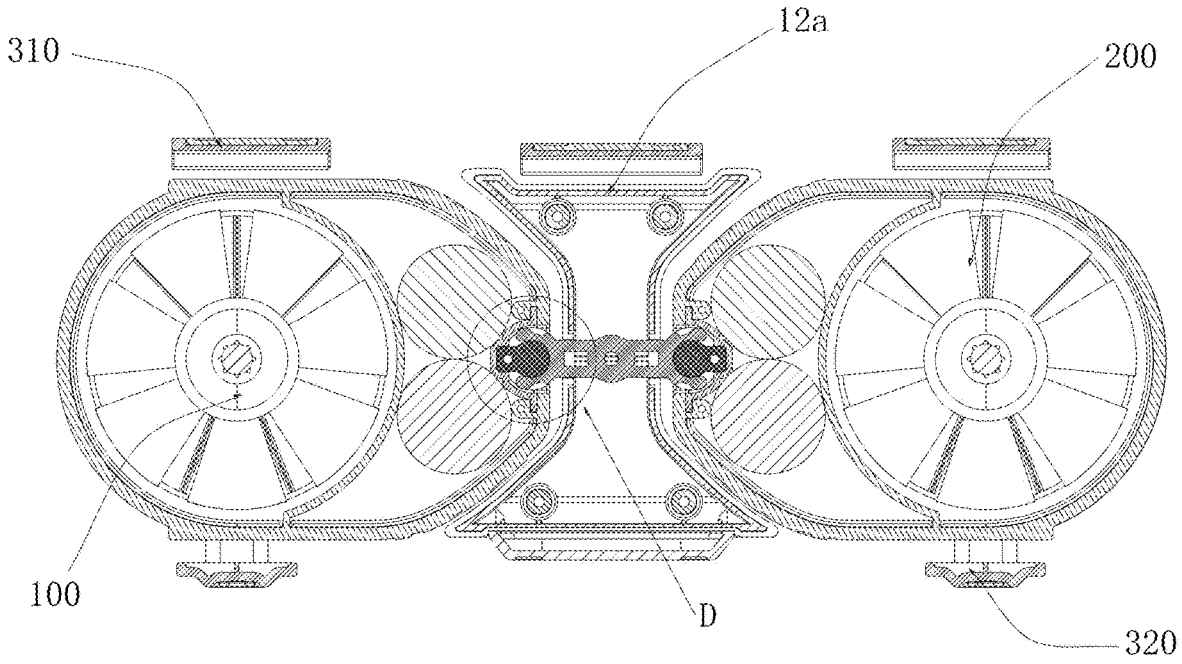
FIG. 9 is a cross-sectional view of Embodiment I of the present disclosure.
Figure 10:
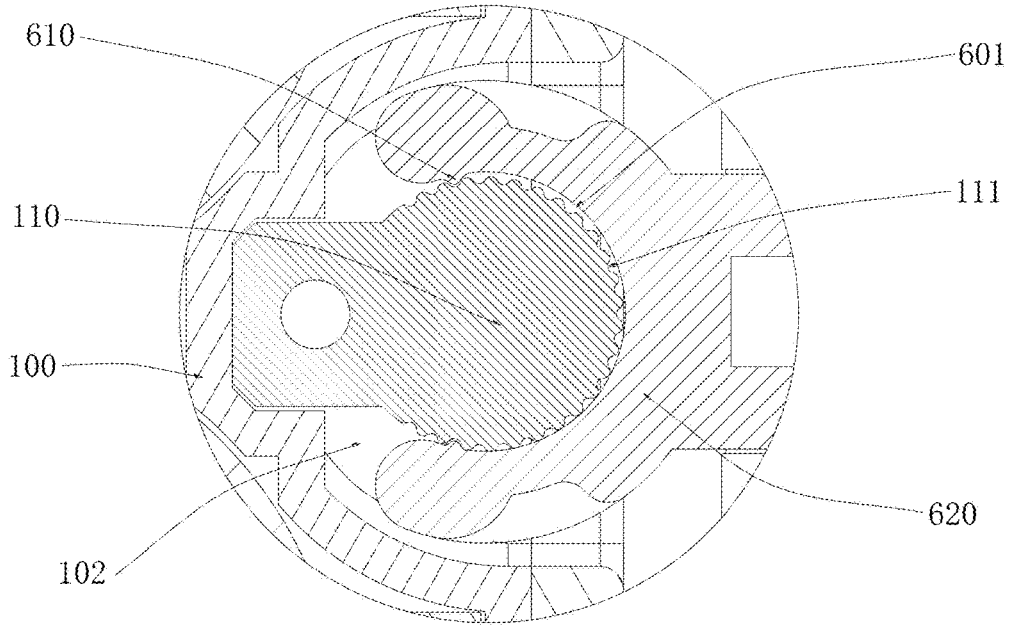
FIG. 10 is an enlarged view of circle D in FIG. 9.
Figure 11:
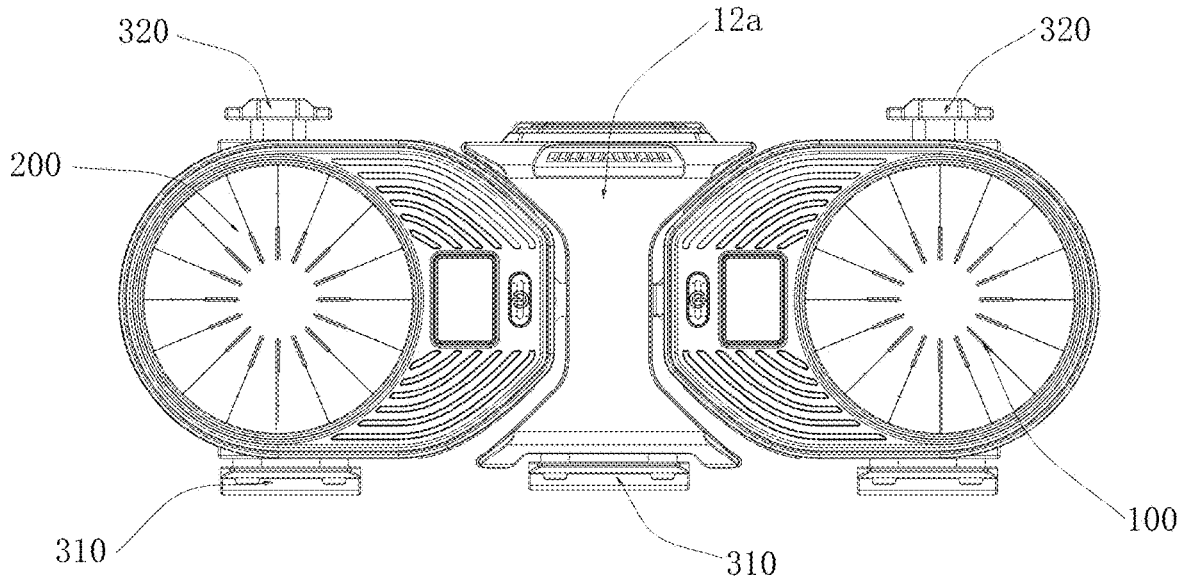
FIG. 11 is a top view of a first state of Embodiment I of the present disclosure.
Figure 12:
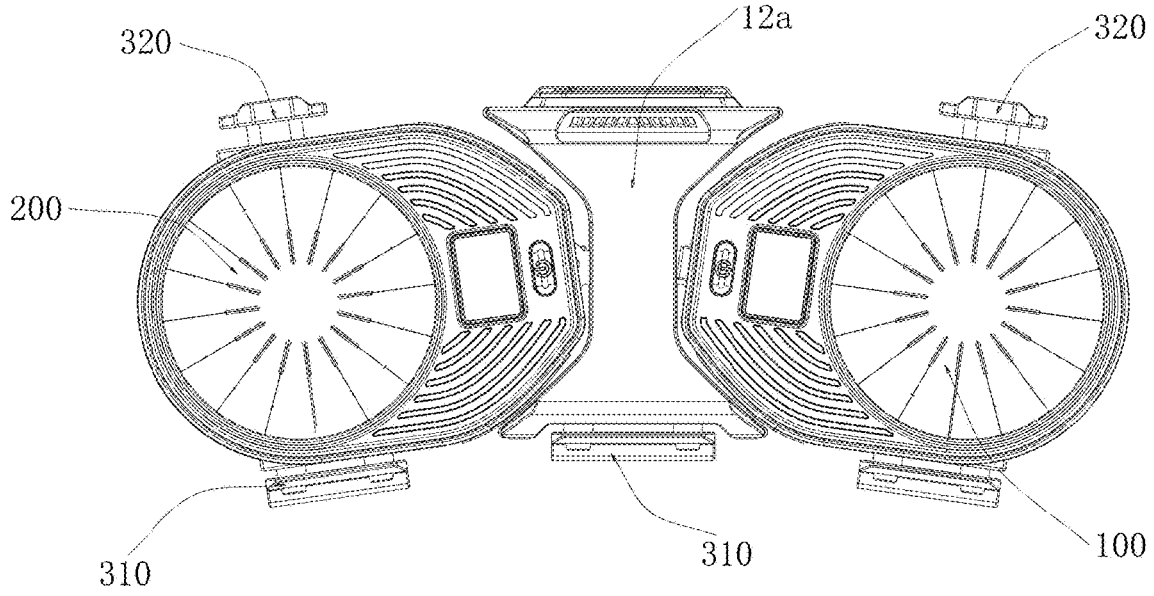
FIG. 12 is a top view of a second state of Embodiment I of the present disclosure.
Figure 13:
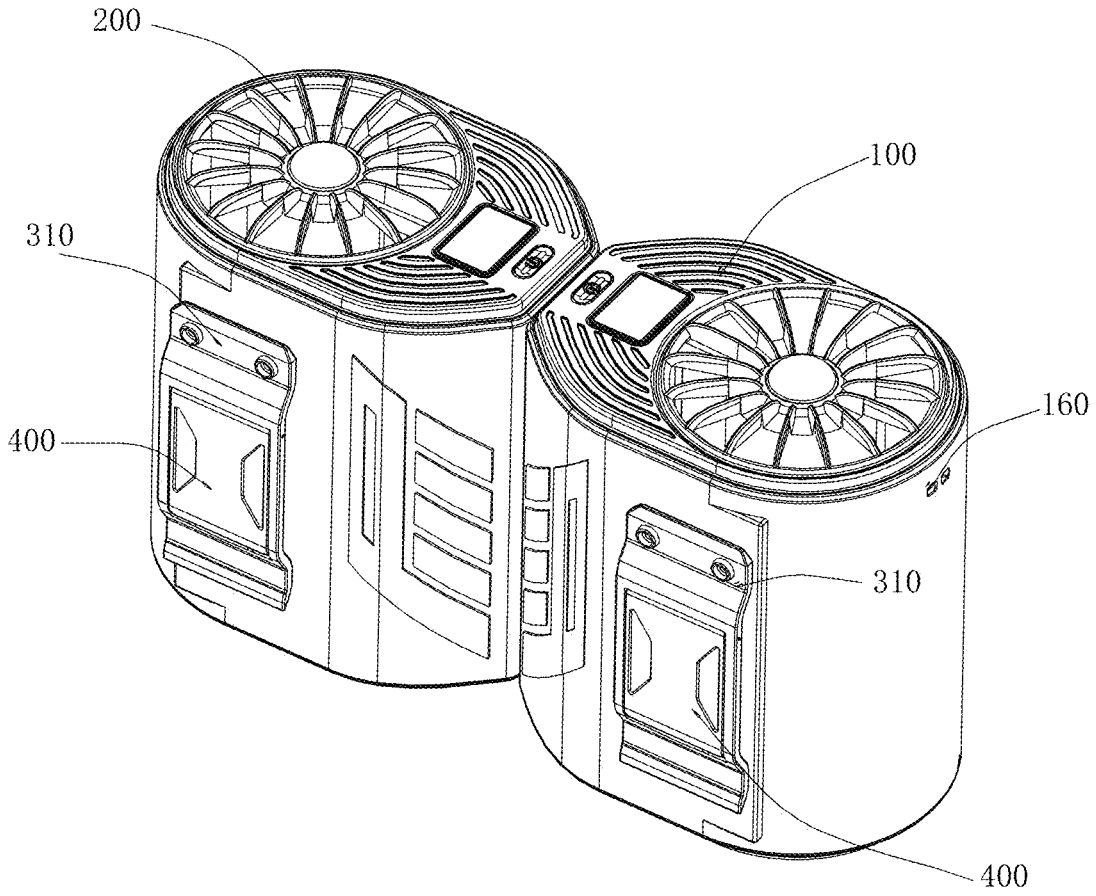
FIG. 13 is a schematic diagram of an entire structure of Embodiment II of the present disclosure.
Figure 14:
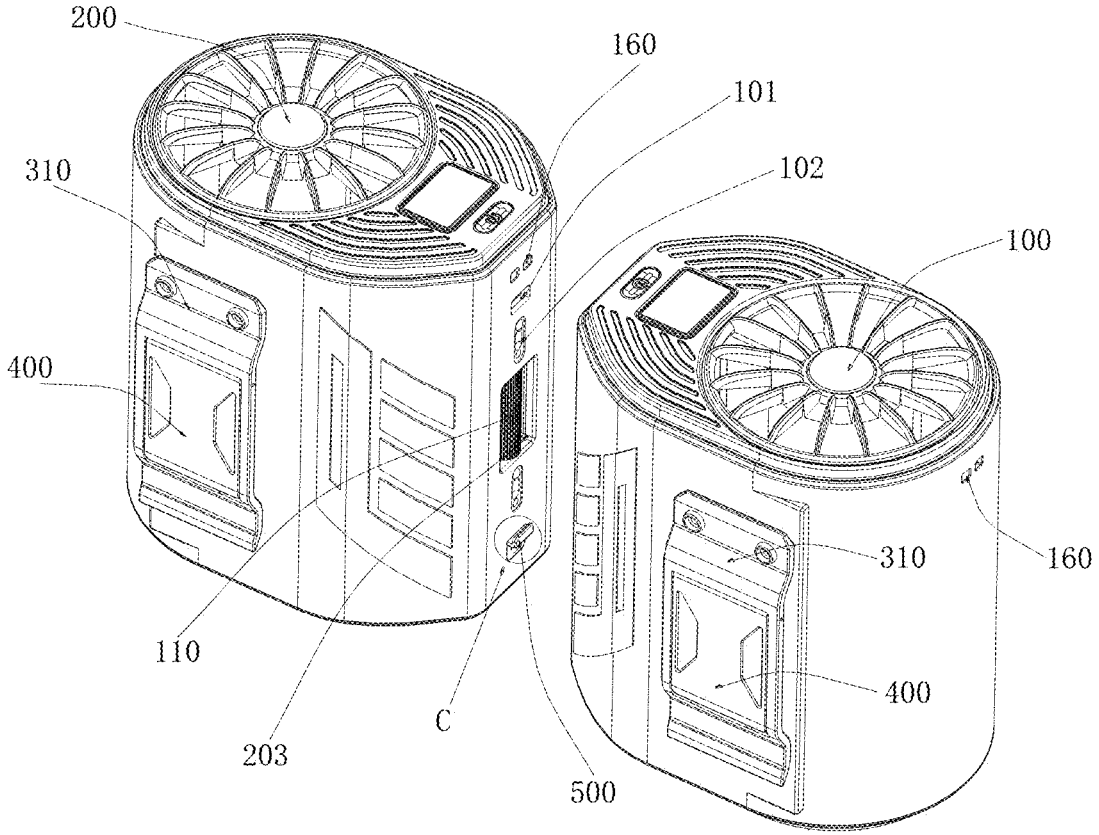
FIG. 14 is an exploded structural diagram of Embodiment II of the present disclosure.
Figure 15:
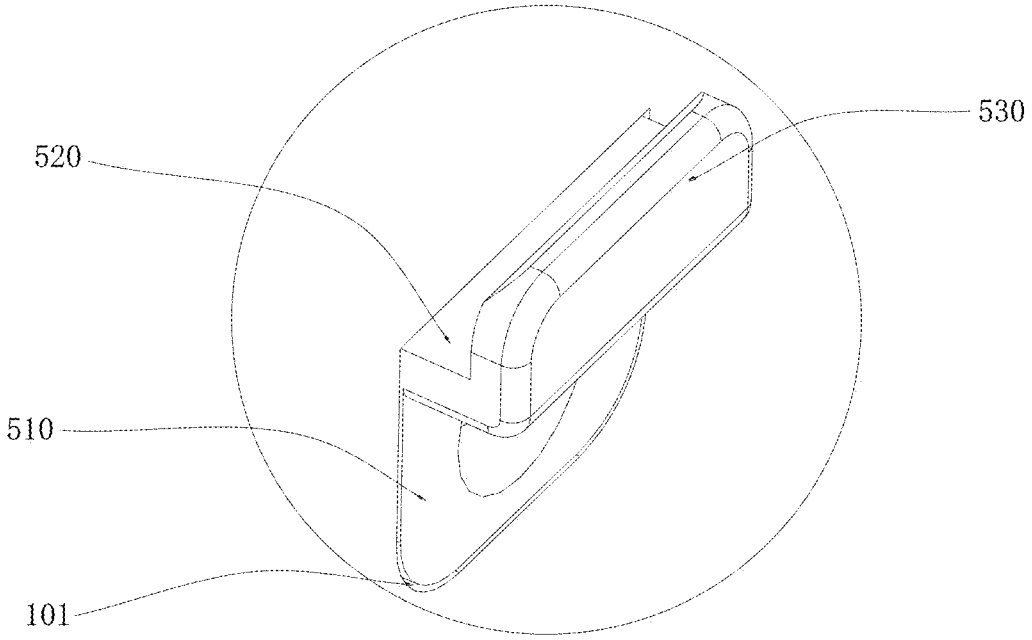
FIG. 15 is an enlarged view of circle C in FIG. 14.
Figure 16:
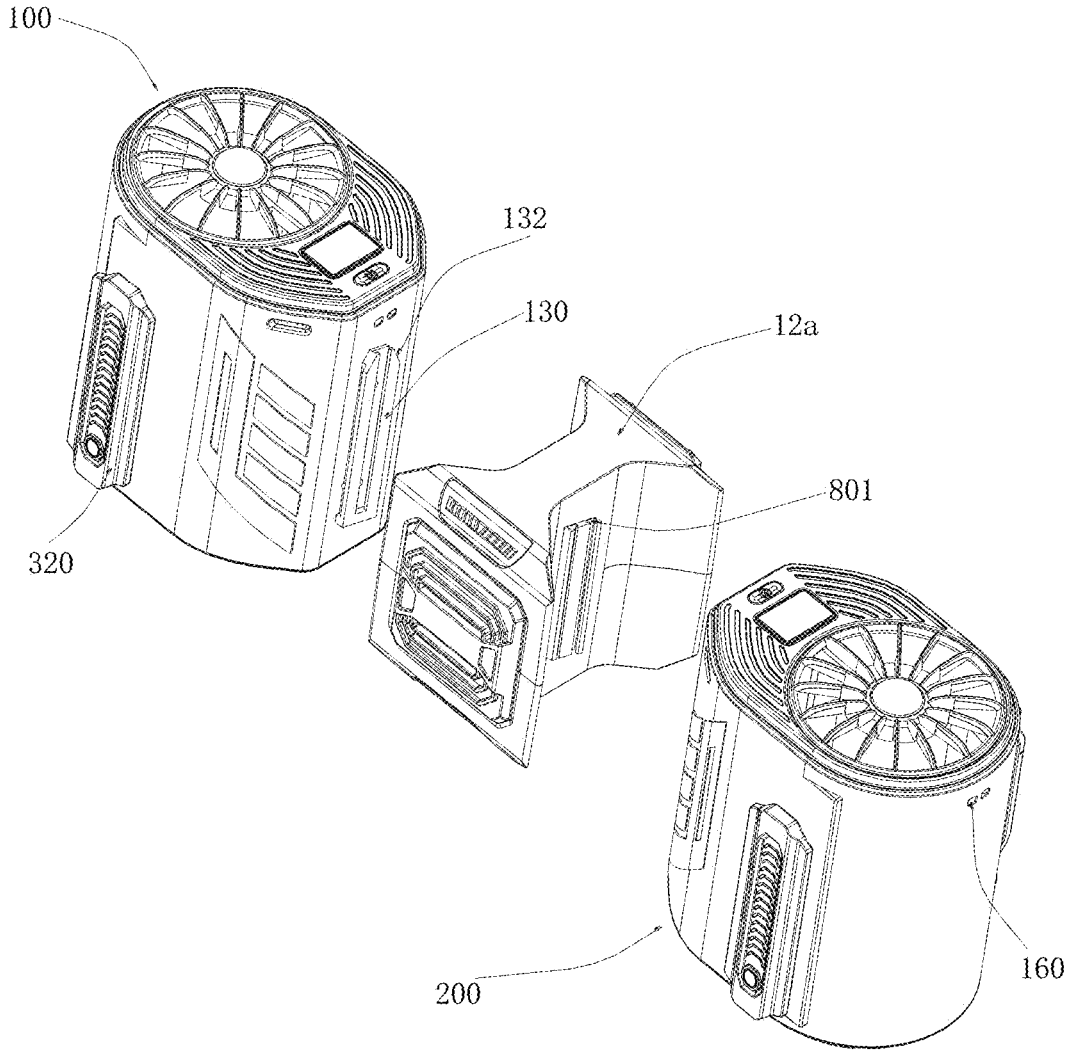
FIG. 16 is a first exploded structural diagram of Embodiment III of the present disclosure.
Figure 17:
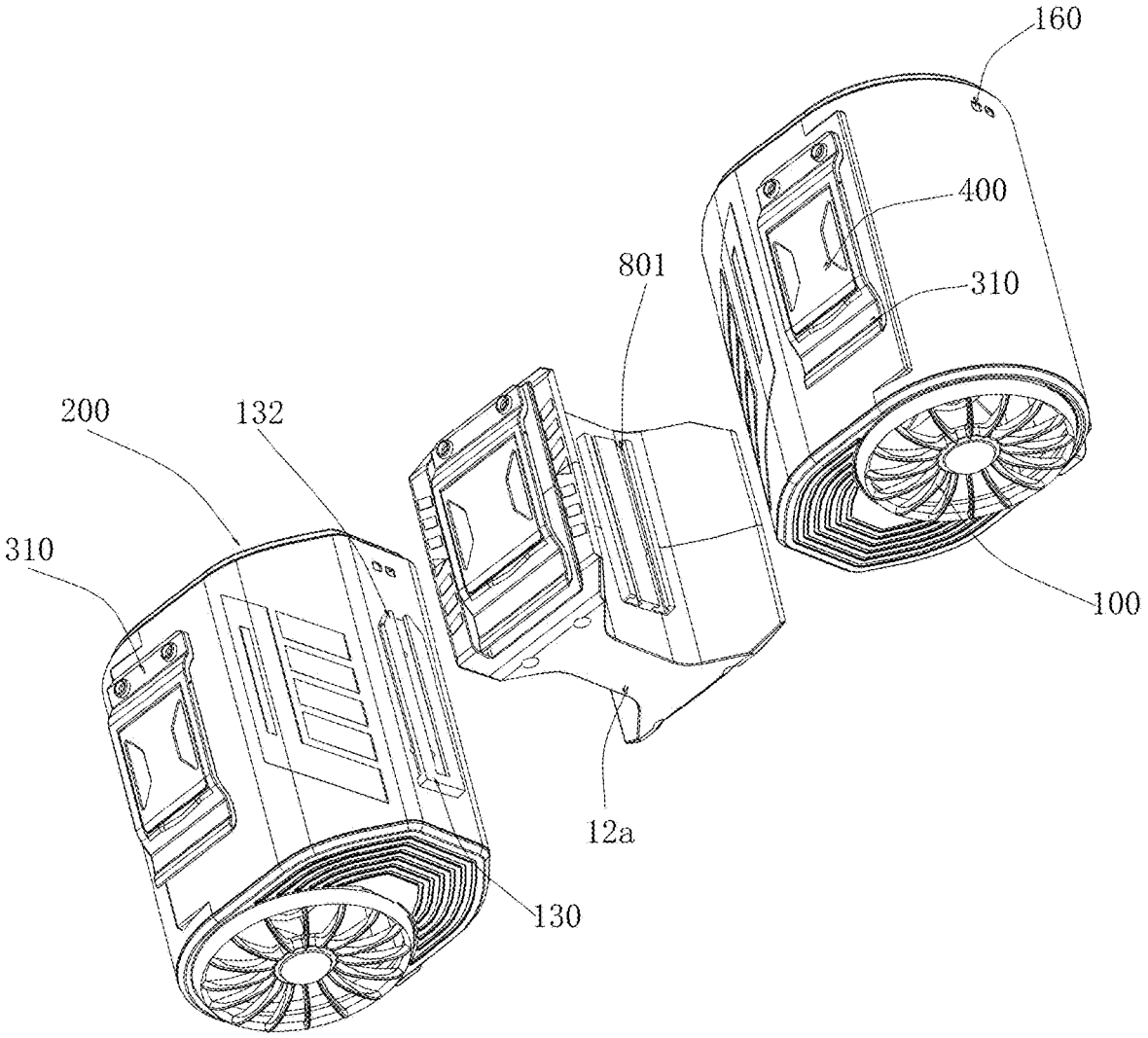
FIG. 17 is a second exploded structural diagram of Embodiment Ill of the present disclosure.
Figure 18:
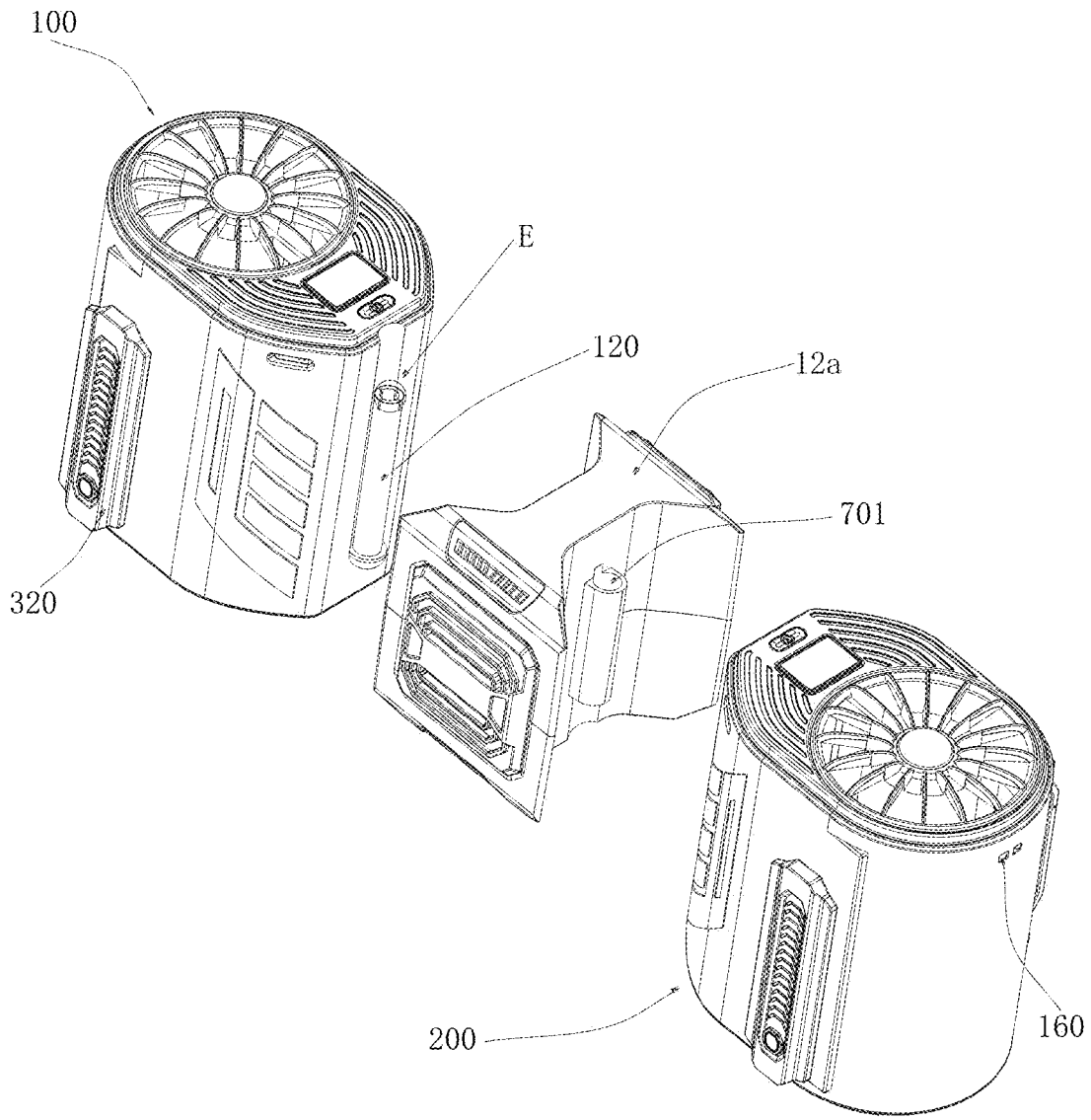
FIG. 18 is a first exploded structural diagram of Embodiment IV of the present disclosure.
Figure 19:
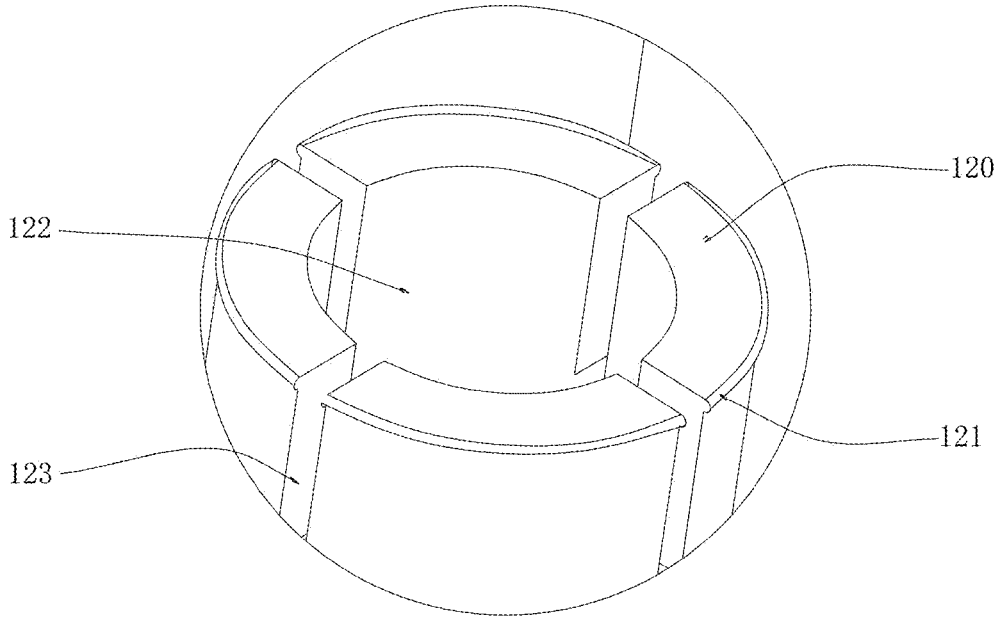
FIG. 19 is an enlarged view of circle E in FIG. 18.
Figure 20:
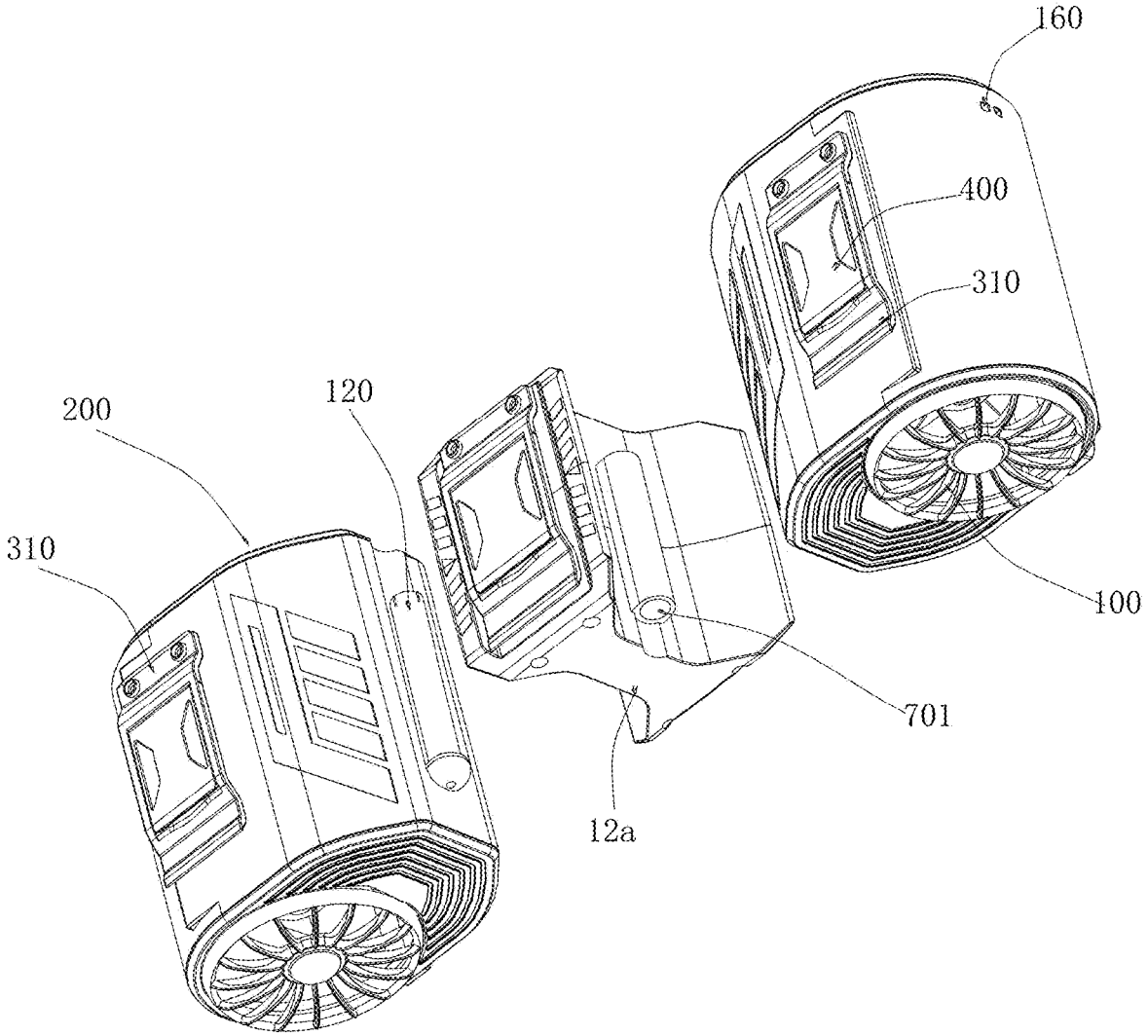
FIG. 20 is a second exploded structural diagram of Embodiment IV of the present disclosure.
Figure 21:
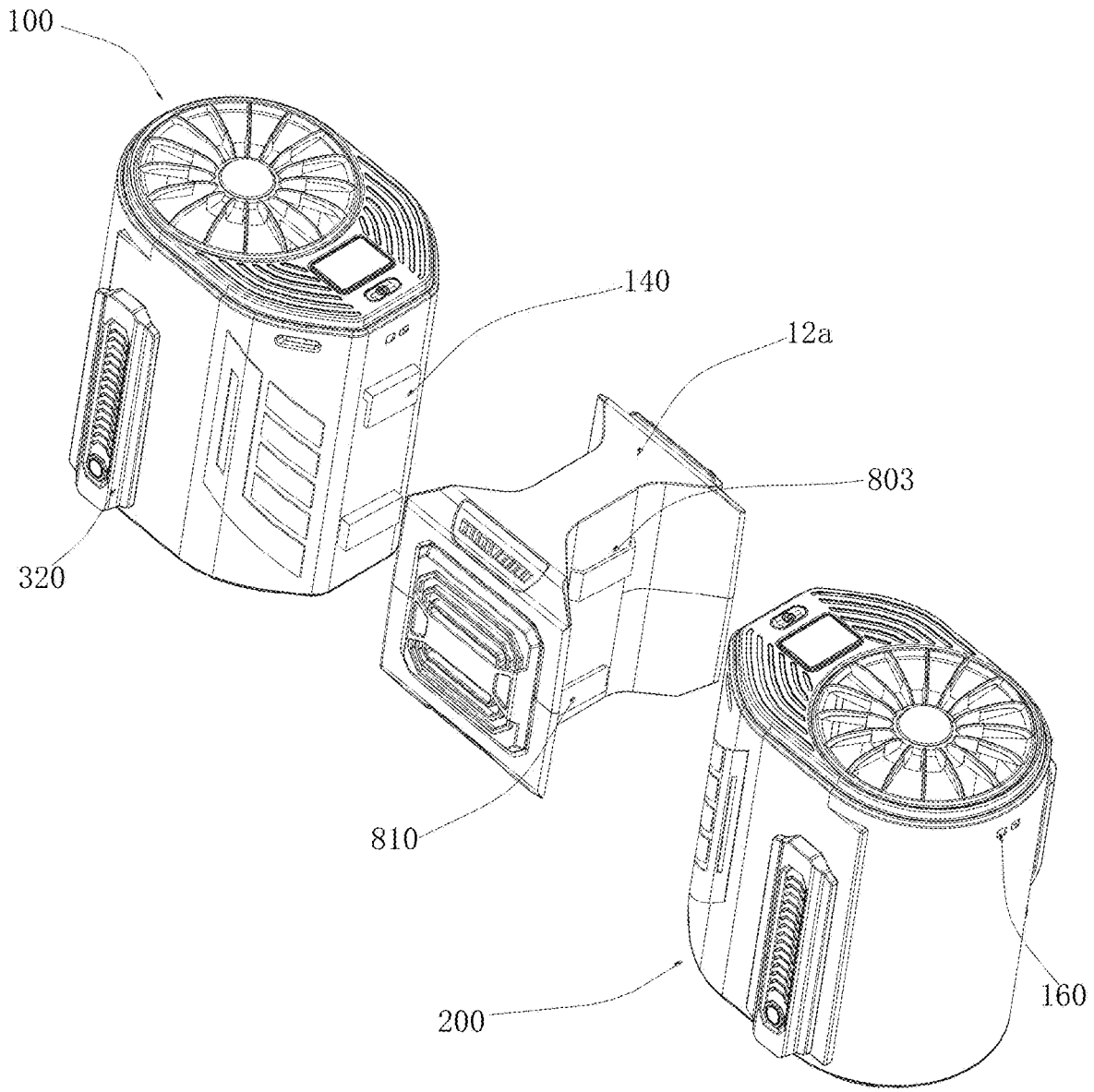
FIG. 21 is a first exploded structural diagram of Embodiment V of the present disclosure.
Figure 22:
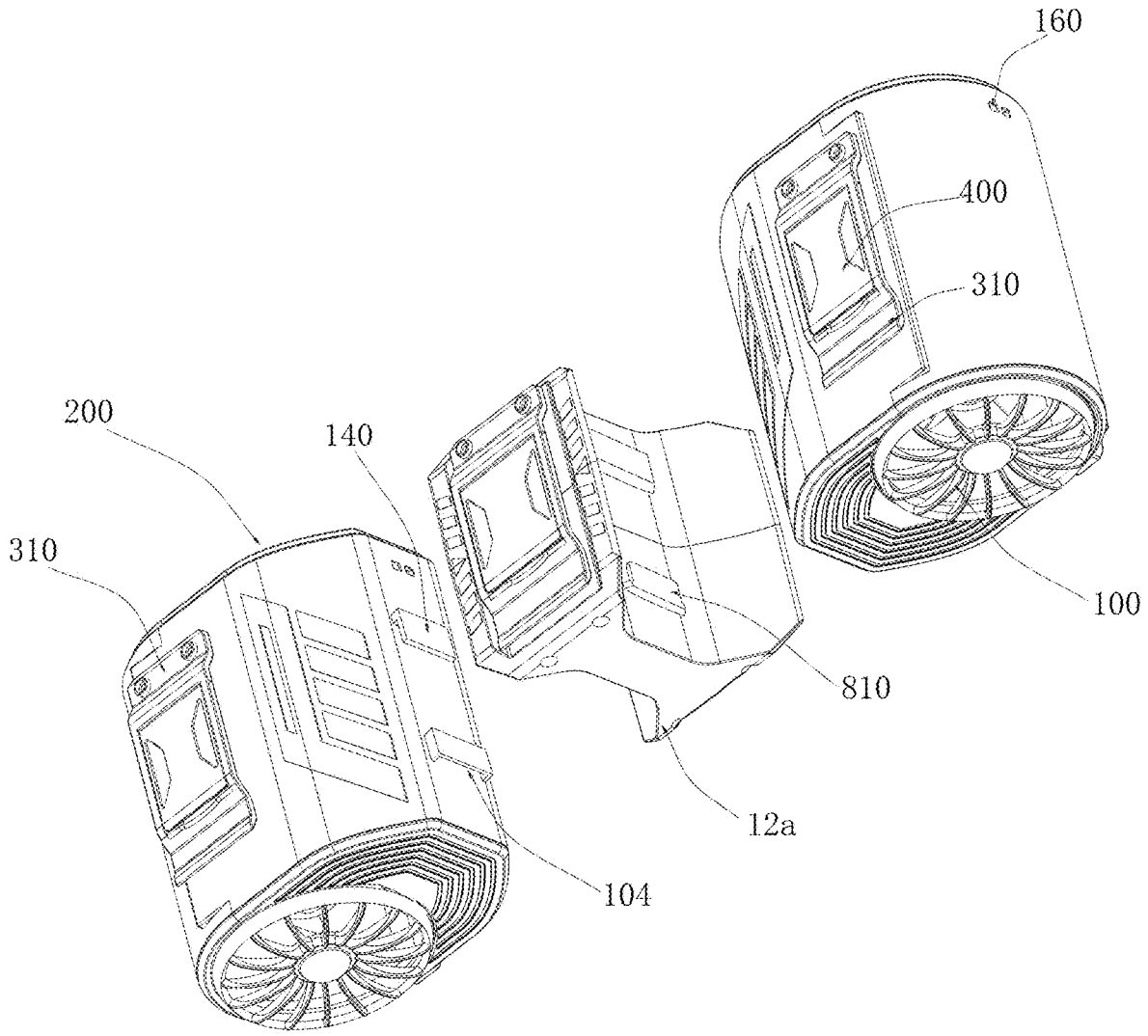
FIG. 22 is a second exploded structural diagram of Embodiment V of the present disclosure.
Figure 23:
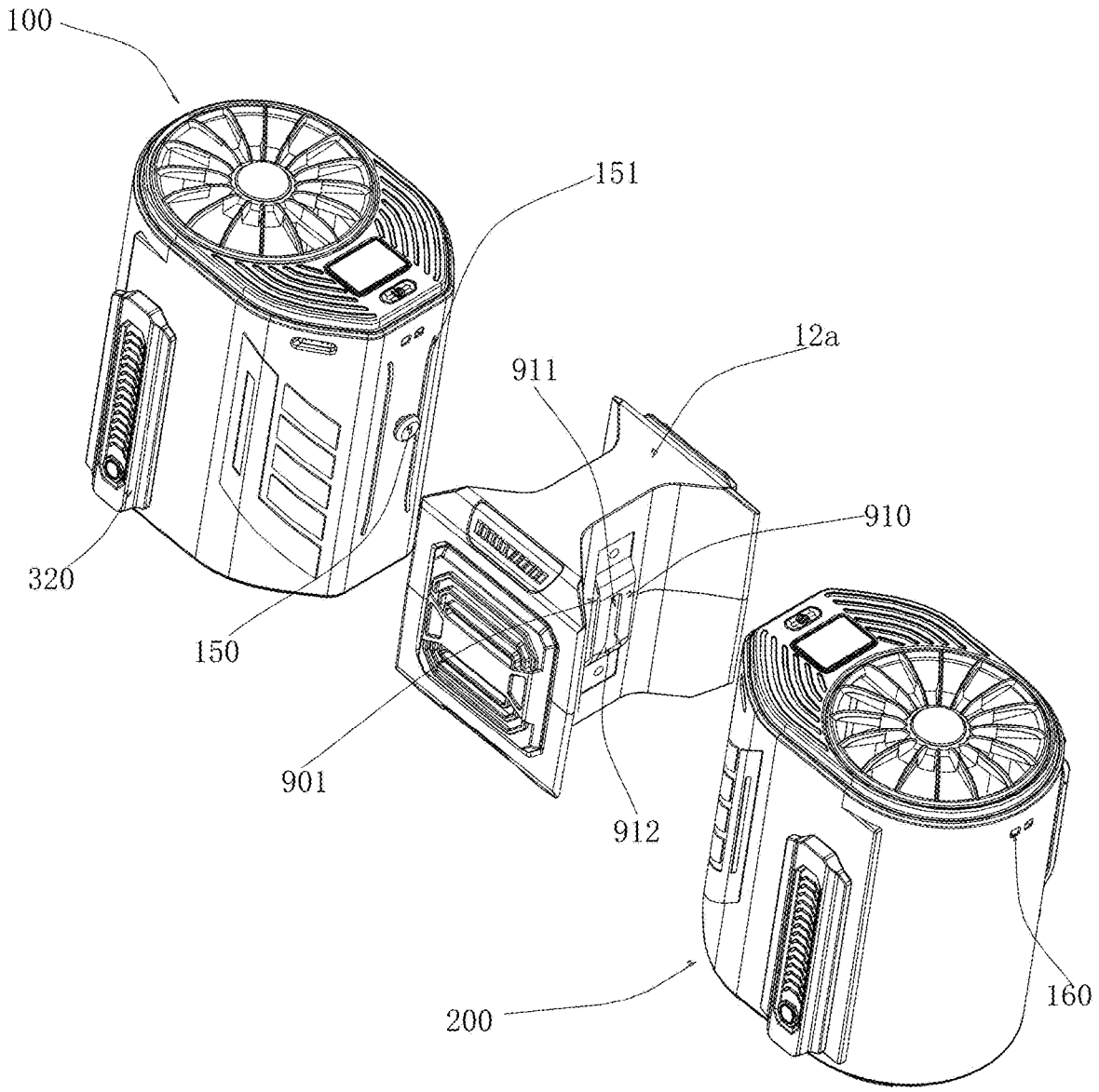
FIG. 23 is a first exploded structural diagram of Embodiment VI of the present disclosure.
Figure 24:
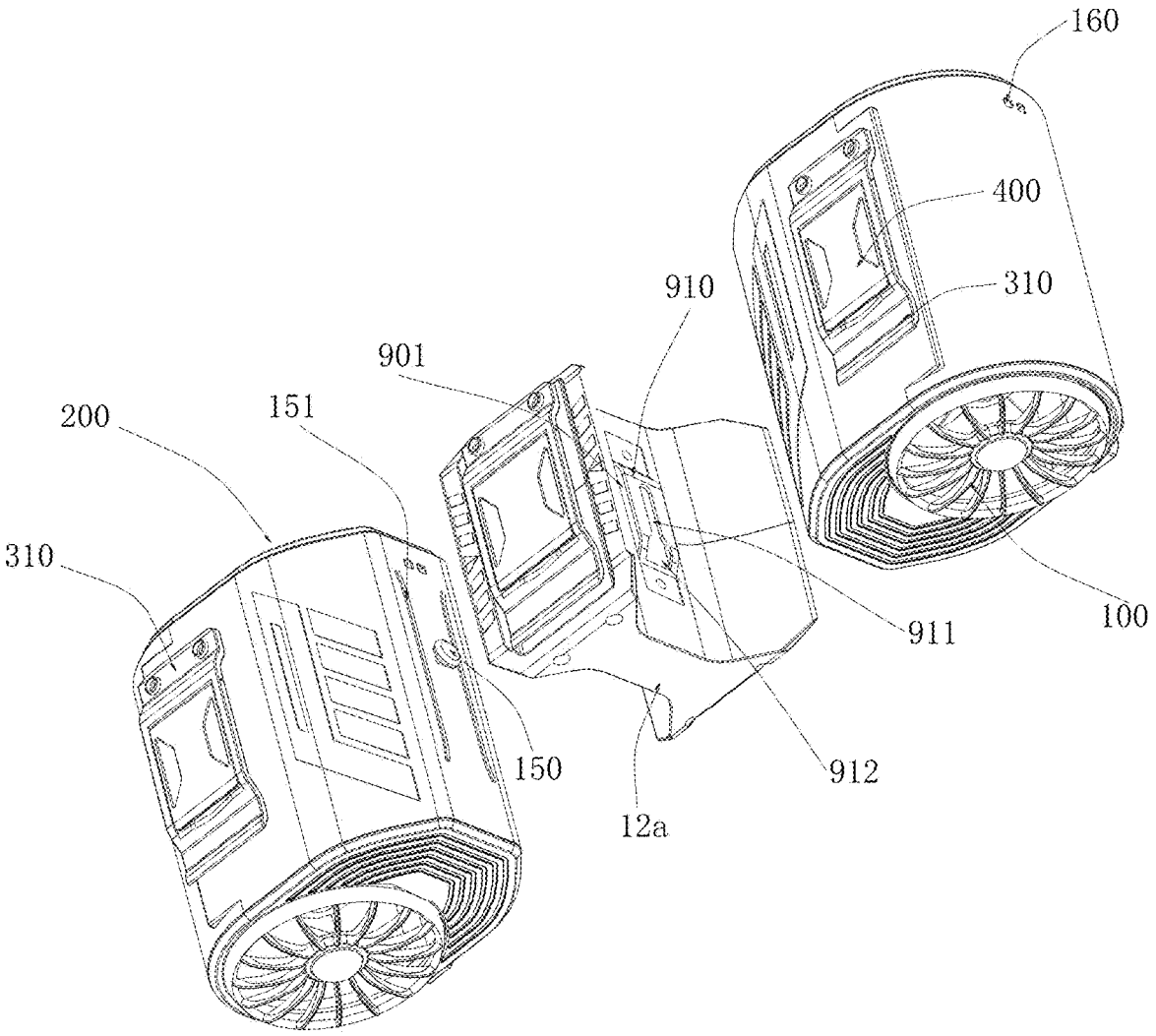
FIG. 24 is a second exploded structural diagram of Embodiment VI of the present disclosure.

Referring to FIG. 1 to FIG. 24, a combined fan includes:

- a first fan 100, provided with a first connecting portion;
- a second fan 200, provided with a second connecting portion;
- a connector, connected to the first connecting portion and the second connecting portion to connect the first fan 100 with the second fan 200 in parallel; and
- a first clamping member 310, wherein the first clamping member 310 is arranged on at least one of the first fan 100, the second fan 200, and the connector, and the first clamping member 310 is configured to be connected to a clamping position.

By the arrangement of the above structure, during use, the connector is connected to the first connecting portion and the second connecting portion, thereby connecting the first fan 100 to the second fan 200 to form a whole. By clamping and connecting the first clamping member 310 to clothing such as a belt and a waistband, the combined fan can be fixed, freeing up the hands of a user and making it convenient for use.

In this embodiment, the combined fan further includes a supporting member 400. The supporting member 400 is rotatably connected to the first clamping member 310 through a connecting shaft 410 and is rotated between a closed position and an opened position. The first clamping member 310 is provided with a groove 301. When the supporting member 400 is rotated to the closed position, at least a part of the supporting member 400 is inserted into the groove 301. When the supporting member 400 is rotated to the opened position, an outer surface of the supporting member 400 resists against an inner wall of the groove 301. By the arrangement of above structure, during use, the first clamping member 310 can be removed from the clothing such as the belt and the waistband of the user, and the supporting member 400 can be rotated to the opened position. At this time, the outer surface of the supporting member 400 resists against the inner wall of the groove 301, and a free end of the supporting member 400 resists against a placement plane such as a tabletop, so that the combined fan is slantways placed on the tabletop, facilitating use. Alternatively, the supporting member 400 is rotated to the closed position. At this time, the supporting member 400 is inserted into the groove 301, and the supporting member 400 basically abuts against the first clamping member 310, which is convenient for the user to clamp and fix the first clamping member to the clothing of the user.

In this embodiment, a clamping block 420 is arranged on one of an edge of the supporting member 400 and the inner wall of the groove 301; a clamping slot 302 is provided in the other one of the edge of the supporting member 400 and the inner wall of the groove 301; and when the supporting member 400 is rotated to the closed position, the clamping block 420 is clamped to the clamping slot 302. By the arrangement of the above structure, during use, the clamping block 420 is clamped in the clamping slot 302, which can effectively fix the supporting member 400, prevent the supporting member 400 from being separated from the groove 301, ensure the stability of the product, and facilitate the user to clamp the first clamping member 310 on the clothing of the user.

In this embodiment, the first clamping member 310 is further provided with a finger groove 303; and the finger groove 303 is communicated to the groove 301 and is configured to allow a finger of a user to be inserted for use. By the arrangement of the above structure, during use, the user inserts the finger along the finger groove 303 and pulls the supporting member 400 hardly to separate the clamping block 420 from the clamping slot 302, making it convenient for the user to rotate the supporting member 400 to the opened position.

In this embodiment, the combined fan further includes a second clamping member 320; a connecting end of the first clamping member 310 is connected to an upper part of a front surface of the first fan 100 and/or an upper part of a front surface of the second fan 200; a clamping end of the first clamping member 310 extends towards a lower part of the front surface of the first fan 100 and/or a lower part of the front surface of the second fan 200; a connecting end of the second clamping member 320 is connected to a lower part of a rear surface of the first fan 100 and/or a lower part of a rear surface of the second fan 200; and a clamping end of the second clamping member 320 extends towards an upper part of the rear surface of the first fan 100 and/or an upper part of the rear surface of the second fan 200. By the arrangement of the above structure, during use, the user can use the first clamping member 310 to clamp and fix the combined fan to the clothing of the user. At this time, air outlets of both the first fan 100 and the second fan 200 face upwards. The user can also use the second clamping member 320 to clamp and fix the combined fan to the clothing of the user. At this time, the air outlets of both the first fan 100 and the second fan 200 face downwards. By using different clamping members, the orientations of the air outlets of both the first fan 100 and the second fan 200 can be changed, making it easier for the user to use the fan to blow and cool different body parts. The combined fan is more convenient to use.

In this embodiment, the connector is a hook 500; the hook 500 includes a connecting portion 510, an extending portion 520, and a hook portion 530; the first connecting portion and/or the second connecting portion are connecting holes 101; the second connecting portion and/or the first connecting portion are L-shaped hook slots 201; the connecting portion 510 is connected to the connecting holes 101; the hook portion 530 and at least a part of the extending portion 520 are inserted into the hook slot 201; and the hook portion 530 is clamped to the hook slot 201. By the arrangement of the above structure, during use, the connecting portion 510 is connected to the connecting holes 101 to fix the hook 500 onto the first fan 100 and/or the second fan 200. Then, the first fan 100 and the second fan 200 are moved towards each other, so that the extending portion 520 and the hook portion 530 are inserted along an opening of the hook slot 201, so that the first fan 100 and the second fan 200 slide relative to each other, to slide the hook portion 530 into an inner wall of the hook slot 201, so that the hook portion 530 is clamped to the inner wall of the hook slot 201, which effectively fixes the first fan 100 and the second fan 200 through the hook 500 and makes the structure of the product more stable. Preferably, the combined fan can further include a third fan and a fourth fan, both of which are connected in sequence through the hook 500.

In this embodiment, a first positioning portion 102 is arranged on a surface of the first fan 100; and a second positioning portion 202 is arranged on a surface of the second fan 200. When the first fan 100 and the second fan 200 are connected by the hook 500, the first positioning portion 102 is clamped to the second positioning portion 202. By the arrangement of the above structure, during use, the first positioning portion 102 is clamped to the second positioning portion 202, which can hinder the first fan 100 from translating relative to the second fan 200, so that the hook portion 530 always resists against the inner wall of the hook slot 201, making the connection between the first fan 100 and the second fan 200 firmer and ensuring the stability of the product. Meanwhile, the first positioning portion 102 and the second positioning portion 202 cooperate with each other and achieve a foolproof effect. Only when the air outlet of the first fan 100 and the air outlet of the second fan 200 face the same direction, the first positioning portion 102 be connected to the second positioning portion 202 to prevent a mounting error of the user.

In this embodiment, "C"-shaped slots 601 are provided in two end portions of the connector; the first connecting portion and the second connecting portion are both provided with cylindrical portions 110; and the cylindrical portions 110 are clamped in the slots 601 and can be rotated inside the slots 601. By the arrangement of the above structure, during use, the cylindrical portions 110 can be inserted into the "C"-shaped slots 601 to connect the first fan 100 and/or the second fan 200 to the connector, facilitating disassembling and assembling. Meanwhile, the cylindrical portions 110 can be rotated in the slots 601, it is convenient for the user to adjust an angle between the first fan 100 and the connector and an angle between the second fan 200 and the connector and to change the shape of the product. When the first clamping member 310 or the second clamping member 320 is used to connect the product to the clothing of the user, the product fits more closely to the body of the user, and the user has a better use experience when carrying the product.

In this embodiment, stop blocks 610 are arranged on inner walls of the slots 601; the cylindrical portions 110 are provided with stop slots 111 spaced apart from each other in a circumferential direction; and when the cylindrical portions 110 are rotated relative to the slots 601, the stop blocks 610 slide from one stop slot 111 to the other adjacent stop slot 111. By the arrangement of the above structure, when the stop blocks 610 are located in the stop slots 111 during use, the cylindrical portions 110 can be limited to prevent the cylindrical portions from being rotated in the slots 601, thereby restricting relative rotation between the first fan 100 and the connector, and relative rotation between the second fan 200 and the connector. The angle between the first fan 100 and the connector and the angle between the second fan 200 and the connector are fixed to ensure the stability of the structure of the product. When the angle between the first fan 100 and the connector and the angle between the second fan 200 and the connector need to be adjusted, the first fan 100 and/or the second fan 200 are rotated hardly to make the stop blocks 610 slide into the other stop slot 111.

In this embodiment, two gaps 602 are provided in two end portions of the connector in a manner of spacing away from each other in axial directions of the cylindrical portions 110; the two gaps 602 penetrate through side walls of the slots 601 and are communicated to the slots 601; the side walls of the slots 601 between the two gaps 602 are deformation portions 620; the stop blocks 610 are arranged at the deformation portions 620; and extending directions of the stop blocks 610 and extending directions of the stop slots 111 are parallel to the axial directions of the cylindrical portions 110. By the arrangement of the above structure, when the cylindrical portions 110 are inserted along the "C"-shaped slots 601, the deformation portions 620 are pushed to deform and be opened to allow the cylindrical portions 110 to be fully inserted into the slots 601. The deformation portions 620 are reset and clamp the cylindrical portions 110 to effectively fix the cylindrical portions 110 in the slots 601. When the cylindrical portions 110 are rotated in the slots 601, the stop blocks 610 slide from one stop slot 111 to the other adjacent stop slot 111. The stop blocks 610 are arranged at the deformation portions 620, which can make the stop blocks 610 slide more smoothly between the plurality of stop slots 111, making it easier for the user to adjust the product. The two gaps 602 spaced part from each other separate the deformation portions 620 from other parts, making it easier for the deformation portions 620 to deform. This not only facilitates assembling of the product by the user, but also makes it easier for the user to rotate the product, thereby improving the comfort of use of the product.

In this embodiment, the first fan 100 is provided with a first accommodating slot 103; the second fan 200 is provided with a second accommodating slot 203; the two cylindrical portions 110 are respectively arranged in the first accommodating slot 103 and the second accommodating slot 203; and two end portions of the connector are respectively inserted into the first accommodating slot 103 and the second accommodating slot 203, so that the two cylindrical portions 110 are respectively clamped in the two slots 601. By the arrangement of the above structure, the cylindrical portions 110 are arranged in the first accommodating slot 103 and/or second accommodating slot 203, so that outer surfaces of the cylindrical portions 110 are roughly leveled with an outer surface of the first fan 100 and/or an outer surface of the second fan 200, which can effectively protect the cylindrical portions 110 and prevent the cylindrical portions 110 from being broken under force. When the cylindrical portions 110 are matched with the "C"-shaped slots 601, the side walls of the "C"-shaped slots 601 are at least partially inserted into the first accommodating slot 103 and/or the second accommodating slot 203, and the slots 601 in the two end portions of the connector can be effectively protected, thereby further improving the stability of the product.

In this embodiment, shaft holes 701 are provided in two end portions of the connector; both the first connecting portion and the second connecting portion are rotating shafts 120; and the rotating shafts 120 are inserted into the shaft holes 701 and rotate inside the shaft holes 701. By the arrangement of the above structure, during assembling of the product, the rotating shafts 120 are inserted into the shaft holes 701, so that the first fan 100 and/or the second fan 200 are stably connected to the connector. Meanwhile, the rotating shafts 120 can rotate in the shaft holes 701, making it convenient for the user to adjust the angle between the first fan 100 and the connector and the angle between the second fan 200 and the connector, thereby changing the shape of the product. Preferably, damping fit between the rotating shafts 120 and inner walls of the shaft holes 701 facilitates the user to fix the angle between the first fan 100 and the connector and the angle between the second fan 200 and the connector, thereby improving the comfort of use of the product.

In this embodiment, clamping blocks 121 are arranged at free ends of the rotating shafts 120; when the rotating shafts 120 are inserted into the shaft holes 701, the clamping blocks 121 are connected to positions, close to edges of the shaft holes 701, on the connector; central through holes 122 and deformation slots 123 communicated to the central through holes 122 are provided in the free ends of the rotating shafts 120; and when the free ends of the rotating shafts 120 are inserted along the shaft holes 701, the deformation slots 123 allow the free ends of the rotating shafts 120 to deform. By the arrangement of the above structure, when the rotating shafts 120 are inserted into the shaft holes 701, the clamping blocks 121 are clamped to the edges of the shaft holes 701 to effectively limit the axial movement of the rotating shafts 120, thereby ensuring the stability of the product. The central through holes 122 and the deformation slots 123 communicated to the central through holes 122 are provided in the free ends of the rotating shafts 120, so that a deformation space can be provided when the free ends of the rotating shafts 120 are inserted into the shaft holes 701, so that the rotating shafts 120 and the clamping blocks 121 at the end portions of the rotating shafts can pass through the shaft holes 701 more easily, thereby lowering the assembling difficulty and improving the assembling efficiency of the product.

In this embodiment, sliding chutes 801 are arranged at two end portions of the connector; the first connecting portion and the second connecting portion are both sliding blocks 130; and the sliding blocks 130 are slidably inserted into the sliding chutes 801. By the arrangement of the above structure, during use, the sliding blocks 130 are inserted along the sliding chutes 801 to connect the first fan 100 and/or the second fan 200 to the connector, so that the product is convenient to assemble, and the production efficiency is high.

In this embodiment, positioning portions are arranged on surfaces of the sliding blocks 130 in a protruding manner; positioning slots are provided in inner walls of the sliding chutes 801; the positioning portions are clamped with the positioning slots; guide portions 132 with narrow front parts and wide rear parts are arranged at end portions of the sliding blocks 130; and the guide portions 132 are inserted along the end portions of the sliding chutes 801 to guide the sliding blocks 130 to enter the sliding chutes 801. By the arrangement of the above structure, during use, when the sliding blocks 130 slide along the sliding chutes 801 to an assembling position during use, the positioning portions are clamped to the positioning slot to hinder relative sliding between the sliding blocks 130 and the sliding chutes 801, thereby fixedly connecting the first fan 100 and/or the second fan 200 to the connector and improving the stability of the product. The guide portions 132 with the narrow front parts and the wide rear parts are arranged at the end portions of the sliding blocks 130, so that it is convenient for the user to insert the guide portions 132 along the end portions of the sliding chutes 801, thereby inserting the entire sliding blocks 130 into the sliding chutes 801 and improving the efficiency of assembling the product.

In this embodiment, a first insertion slot 803 and a first insertion block 810 are arranged at each of two end portions of the connector, and each of the first connecting portion and the second connecting portion includes a second insertion slot 104 and a second insertion block 140; the first insertion blocks 810 are inserted into the second insertion slots 104, and the second insertion blocks 140 are inserted into the first insertion slots 803; and an orientation of a free end of each first insertion block 810 is opposite to an orientation of a free end of each second insertion block 140. By the arrangement of the above structure, during use, the first insertion blocks 810 are inserted into the second insertion slots 104, and the second insertion blocks 140 are inserted into the first insertion slots 803, which can connect the first fan 100 and/or the second fan 200 to the connector and facilitate the assembling. The orientations of the free ends of the first insertion blocks 810 are opposite to the orientations of the free ends of the second insertion blocks 140, which can achieve fool prevention. When the air outlet of the first fan 100 and the air outlet of the second fan 200 are consistent, the first insertion blocks 810 can be inserted into the second insertion slots 104, and the second insertion blocks 140 can be inserted into the first insertion slots 803 to prevent a mounting mistake of the user.

In this embodiment, limiting sheets 910 are arranged at two end portions of the connector; a limiting slot 901 is formed between each limiting sheet 910 and an end wall of the connector; the limiting sheets 910 are provided with strip-type holes 911 communicated to the limiting slots 901; the first connecting portion and the second connecting portion both include limiting blocks 150; a diameter of a free end of each limiting block 150 is greater than a diameter of a middle part of the limiting block 150; the middle parts of the limiting blocks 150 are inserted into the strip-type holes 911; and the free ends of the limiting blocks 150 are inserted into the limiting slots 901 and resist against inner walls of the limiting slots 901. By the arrangement of the above structure, during use, the limiting blocks 150 are inserted into the limiting slots 901 along the strip-type holes 911, so that the free ends of the limiting blocks 150 resist against the inner walls of the limiting slots 901, and the middle parts of the limiting blocks 150 can slide along the strip-type holes 911 to the mounting position. The product is convenient to assemble and stable in structure.

In this embodiment, the limiting sheets 910 are provided with insertion ports 912 communicated to the strip-type holes 911; the insertion ports 912 are arranged at end portions of the strip-type holes 911; a diameter of each insertion port 912 is greater than the diameter of the free end of each limiting block 150; and the free ends of the limiting blocks 150 are inserted into the limiting slots 901 along the insertion ports 912. By the arrangement of the above structure, during use, the free ends of the limiting blocks 150 are inserted into the limiting slots 901 along the insertion ports 912 to drive the first fan 100 and/or the second fan 200 to translate relative to the connector, thereby allowing the middle parts of the limiting blocks 150 to slide along the strip-type holes 911 to a mounting position. At this time, the free ends of the limiting blocks 150 resist against inner walls of the limiting slots 901, and the connection of the product is stable.

In this embodiment, each of the first connecting portion and the second connecting portion includes two limiting convex strips 151 spaced apart from each other; a distance between the two limiting convex strips 151 matches a width of each limiting sheet 910; and the limiting sheets 910 are inserted along gaps between the two limiting convex strips 151 to cause the free ends of the limiting blocks 150 to be inserted into the limiting slots 901 along the insertion ports 912. By the arrangement of the above structure, the two limiting convex strips 151 that are spaced apart from each other form a mounting track, and the limiting sheets 910 are inserted along the gap between the two limiting convex strips 151, thereby defining a translation direction of the first fan 100 and/or the second fan 200 relative to the connector. This allows the free ends of the limiting blocks 150 to be inserted along the insertion ports 912, thereby facilitating the user to assemble the product.

In this embodiment, the combined fan further includes a connector housing 12*a*; insertion notches are provided in two sides of the connector housing 12*a*; the connector is connected to the connector housing 12*a* and at least partially located in the insertion notches; and the first fan 100 and the second fan 200 are inserted along the insertion notches and connected to the connector. By the arrangement of the above structure, an edge of the connector housing 12*a* can effectively protect the connector, the first fan 100, and the second fan 200, improve the stability of the product, prevent breakage from a joint, make the product firmer and more durable.

In this embodiment, the first fan 100 and/or the second fan 200 is provided with a rope hole 160; and the rope hole 160 is configured to allow a rope to pass through. By the arrangement of the above structure, during use, a hanging rope or a connecting ring can be threaded through the rope hole 160 to form a hanging component, which is convenient for the user to hang the product.

The invention claimed is:

1. A combined fan, comprising:

a first fan, provided with a first connecting portion;

a second fan, provided with a second connecting portion;

a connector, connected to the first connecting portion and the second connecting portion to connect the first fan with the second fan in parallel;

a first clamping member, wherein the first clamping member is arranged on at least one of the first fan, the second fan, and the connector, and the first clamping member is configured to be connected to a clamping position; and a second clamping member, wherein a connecting end of the first clamping member is connected to an upper part of a front surface of the first fan and/or an upper part of a front surface of the second fan; a clamping end of the first clamping member extends towards a lower part of the front surface of the first fan and/or a lower part of the front surface of the second fan; a connecting end of the second clamping member is connected to a lower part of a rear surface of the first fan and/or a lower part of a rear surface of the second fan; and a clamping end of the second clamping member extends towards an upper part of the rear surface of the first fan and/or an upper part of the rear surface of the second fan.

2. The combined fan according to claim 1, wherein the connector is a hook; the hook comprises a connecting portion, an extending portion, and a hook portion; the first connecting portion and/or the second connecting portion are connecting holes; the second connecting portion and/or the first connecting portion are L-shaped hook slots; the connecting portion is connected to the connecting holes; the hook portion and at least a part of the extending portion are inserted into the hook slot; and the hook portion is clamped to the hook slot.

3. The combined fan according to claim 2, wherein a first positioning portion is arranged on a surface of the first fan; a second positioning portion is arranged on a surface of the second fan; and when the first fan and the second fan are connected by the hook, the first positioning portion is clamped to the second positioning portion.

4. The combined fan according to claim 1, wherein shaft holes are provided in two end portions of the connector; both the first connecting portion and the second connecting portion are rotating shafts; and the rotating shafts are inserted into the shaft holes and rotate inside the shaft holes.

5. The combined fan according to claim 4, wherein clamping blocks are arranged at free ends of the rotating shafts; when the rotating shafts are inserted into the shaft holes, the clamping blocks are connected to positions, close to edges of the shaft holes, on the connector; central through holes and deformation slots communicated to the central through holes are provided in the free ends of the rotating shafts; and when the free ends of the rotating shafts are inserted along the shaft holes, the deformation slots allow the free ends of the rotating shafts to deform.

6. The combined fan according to claim 1, wherein sliding chutes are arranged at two end portions of the connector; the first connecting portion and the second connecting portion are both sliding blocks; and the sliding blocks are slidably inserted into the sliding chutes.

7. The combined fan according to claim 6, wherein positioning portions are arranged on surfaces of the sliding blocks in a protruding manner; positioning slots are provided in inner walls of the sliding chutes; the positioning portions are clamped with the positioning slots; guide portions with narrow front parts and wide rear parts are arranged at end portions of the sliding blocks; and the guide portions are inserted along the end portions of the sliding chutes to guide the sliding blocks to enter the sliding chutes.

8. The combined fan according to claim 1, wherein a first insertion slot and a first insertion block are arranged at each of two end portions of the connector, and each of the first connecting portion and the second connecting portion comprises a second insertion slot and a second insertion block; the first insertion blocks are inserted into the second insertion slots, and the second insertion blocks are inserted into the first insertion slots; and an orientation of a free end of each first insertion block is opposite to an orientation of a free end of each second insertion block.

9. The combined fan according to claim 1, wherein limiting sheets are arranged at two end portions of the connector; a limiting slot is formed between each limiting sheet and an end wall of the connector; the limiting sheets are provided with strip-type holes communicated to the limiting slots; the first connecting portion and the second connecting portion both comprise limiting blocks; a diameter of a free end of each limiting block is greater than a diameter of a middle part of the limiting block; the middle parts of the limiting blocks are inserted into the strip-type holes; and the free ends of the limiting blocks are inserted into the limiting slots and resist against inner walls of the limiting slots.

10. The combined fan according to claim 9, wherein the limiting sheets are provided with insertion ports communicated to the strip-type holes; the insertion ports are arranged at end portions of the strip-type holes; a diameter of each insertion port is greater than the diameter of the free end of each limiting block; and the free ends of the limiting blocks are inserted into the limiting slots along the insertion ports.

11. The combined fan according to claim 9, wherein each of the first connecting portion and the second connecting portion comprises two limiting convex strips spaced apart from each other; a distance between the two limiting convex strips matches a width of each limiting sheet; and the limiting sheets are inserted along gaps between the two limiting convex strips to cause the free ends of the limiting blocks to be inserted into the limiting slots along the insertion ports.

12. The combined fan according to claim 1, wherein the first fan and/or the second fan is provided with a rope hole; and the rope hole is configured to allow a rope to pass through.

13. A combined fan, comprising:

a first fan, provided with a first connecting portion;

a second fan, provided with a second connecting portion;

a connector, connected to the first connecting portion and the second connecting portion to connect the first fan with the second fan in parallel;

a first clamping member, wherein the first clamping member is arranged on at least one of the first fan, the second fan, and the connector, and the first clamping member is configured to be connected to a clamping position; and a supporting member, wherein the supporting member is rotatably connected to the first clamping member through a connecting shaft and is rotated between a closed position and an opened position; the first clamping member is provided with a groove; when the supporting member is rotated to the closed position, at least a part of the supporting member is inserted into the groove; and when the supporting member is rotated to the opened position, an outer surface of the supporting member resists against an inner wall of the groove.

14. The combined fan according to claim 13, wherein a clamping block is arranged on one of an edge of the supporting member and the inner wall of the groove; a clamping slot is provided in the other one of the edge of the supporting member and the inner wall of the groove; and when the supporting member is rotated to the closed position, the clamping block is clamped to the clamping slot.

15. The combined fan according to claim 14, wherein the first clamping member is further provided with a finger groove; and the finger groove is communicated to the groove and is configured to allow a finger of a user to be inserted for use.

16. A combined fan, comprising:

a first fan, provided with a first connecting portion;

a second fan, provided with a second connecting portion;

a connector, connected to the first connecting portion and the second connecting portion to connect the first fan with the second fan in parallel; and a first clamping member, wherein the first clamping member is arranged on at least one of the first fan, the second fan, and the connector, and the first clamping member is configured to be connected to a clamping position;

wherein "C"-shaped slots are provided in two end portions of the connector; the first connecting portion and the second connecting portion are both provided with cylindrical portions; and the cylindrical portions are clamped in the "C"-shaped slots and rotated inside the "C"-shaped slots.

17. The combined fan according to claim 16, wherein stop blocks are arranged on inner walls of the slots; the cylindrical portions are provided with stop slots spaced apart from each other in a circumferential direction; and when the cylindrical portions are rotated relative to the slots, the stop blocks slide from one stop slot to the other adjacent stop slot.

18. The combined fan according to claim 17, wherein two gaps are provided in two end portions of the connector in a manner of spacing away from each other in axial directions of the cylindrical portions; the two gaps penetrate through side walls of the slots and are communicated to the slots; the side walls of the slots between the two gaps are deformation portions; the stop blocks are arranged at the deformation portions; and extending directions of the stop blocks and extending directions of the stop slots are parallel to the axial directions of the cylindrical portions.

19. The combined fan according to claim 16, wherein the first fan is provided with a first accommodating slot; the second fan is provided with a second accommodating slot; the two cylindrical portions are respectively arranged in the first accommodating slot and the second accommodating slot; and two end portions of the connector are respectively inserted into the first accommodating slot and the second accommodating slot, so that the two cylindrical portions are respectively clamped in the two slots.

* * * * *